US007802872B2

(12) United States Patent
Conta et al.

(10) Patent No.: US 7,802,872 B2
(45) Date of Patent: Sep. 28, 2010

(54) INK JET PRINTHEAD AND ITS MANUFACTURING PROCESS

(75) Inventors: Renato Conta, Arnad (IT); Lucia Giovanola, Arnad (IT)

(73) Assignee: Telecom Italia S.p.A., Milan (IT)

( * ) Notice: Subject to any disclaimer, the term of this patent is extended or adjusted under 35 U.S.C. 154(b) by 49 days.

(21) Appl. No.: 10/577,431

(22) PCT Filed: Oct. 27, 2004

(86) PCT No.: PCT/IT2004/000586

§ 371 (c)(1),
(2), (4) Date: Apr. 27, 2006

(87) PCT Pub. No.: WO2005/039880

PCT Pub. Date: May 6, 2005

(65) Prior Publication Data

US 2007/0081037 A1 Apr. 12, 2007

(30) Foreign Application Priority Data

Oct. 27, 2003 (IT) ..... TO2003A0841

(51) Int. Cl.
*B41J 2/05* (2006.01)

(52) U.S. Cl. ..... 347/59

(58) Field of Classification Search ..... None
See application file for complete search history.

(56) References Cited

U.S. PATENT DOCUMENTS 4,879,568 A * 11/1989 Bartky et al. ..... 347/69
4,994,826 A * 2/1991 Tellier ..... 347/65
6,038,367 A 3/2000 Abecassis
6,347,861 B1 * 2/2002 Tom et al. ..... 347/63
6,412,921 B1 * 7/2002 Manini ..... 347/65
6,554,408 B1 * 4/2003 Miki et al. ..... 347/70
6,616,270 B1 * 9/2003 Miyata et al. ..... 347/68
2003/0007034 A1 1/2003 Horvath et al.

FOREIGN PATENT DOCUMENTS

EP 0 666 174 A 8/1995
IT TO2002A00876 10/2001
WO WO2004/033210 A1 4/2004

* cited by examiner

*Primary Examiner*—Stephen D Meier
*Assistant Examiner*—Alexander C Witkowski
(74) *Attorney, Agent, or Firm*—Venable LLP; Robert Kinberg; Steven J. Schwarz

(57) ABSTRACT

Ink jet printhead comprising one or more ejection module, each with a silicon chip, a plurality of ejector nozzles arranged adjacent to a front of the module, ejection cells for the nozzles and delivery channels for the ink of the cells. The module or modules each include a distribution channel adjacent to the front and in fluid communication with the delivery channels and a nozzle layer integrated with the relative chip and in which the ejector nozzles parallel to the front are made. The head also comprises a support on which the module or modules are mounted and which defines a feeding duct for the ink in fluid communication with the delivery channels and sealing means between the module or modules and the support to guarantee fluid tightness between the feeding duct and the ejection cells.

26 Claims, 15 Drawing Sheets

INK JET PRINTHEAD AND ITS MANUFACTURING PROCESS

This invention relates to an ink jet printhead and its manufacturing process.

More specifically the invention relates to a printhead for ejecting ink droplets on a print medium through a plurality of nozzles and its manufacturing process according to the introductory parts of claims 1 and 20.

BACKGROUND OF THE INVENTION

The composition and general mode of operation of an ink jet printhead, for instance one according to the top shooter type thermal technology, i.e. that emits ink droplets in a direction perpendicular to an ejection module, are widely known in the sector art and will not therefore be described in detail here.

Ink jet heads are commonly used in producing serial printers in which the nozzles are arranged perpendicular to the line of print and the head is moved transversally over the surface to be printed.

The ejector units are obtained as chips from a semiconductor substrate, typically a silicon wafer, with processing technologies similar to those employed for the production of integrated and/or hybrid circuits.

In short, various layers are deposited on a face of the substrate to make up the ejection resistors and the active electronic components, and a layer of photopolymer. Using photolithographic techniques, the ejection cells and ink delivery channels are made in the photopolymer and an orifice plate provided with ejection nozzles built in correspondence with the cells is mounted.

Today's technology tends to produce ever larger numbers of nozzles per head, and ever higher print definitions with high working frequency and produce ever smaller ink droplets. This requires actuators of reduced dimensions, very short hydraulic circuits and channels, high levels of precision in positioning and assembling the components, while also accentuating the problems of the differing coefficients of thermal expansion of the materials making up the head.

High reliability is also required of the printheads, especially when there is to be interchangeability of the ink tank. These heads, called semifixed refill heads, have in fact an effective life close to the life of the printers.

Thus there is a need to develop and produce fully integrated, monolithic heads, in which the ink channels, the selection microelectronics, the resistors and the nozzles are integrated in the wafer.

The latest heads for serial printing have a special nozzle disposition along an edge of the ejection module, they use simplified feeds for the ink through a distribution slot or channel in the unit, common to all the cells and, in some cases, have the orifice plate integrated in the unit. During manufacture, a sacrificial layer of photopolymer that is subsequently eliminated is used in making the cells and delivery channels, and a structural layer for formation of the nozzles.

Serial type printers are moreover somewhat cumbersome and, therefore, unsuitable for use with portable and/or compact equipment.

Ink jet heads that can be used in parallel or serial-parallel printers are known. The line of a page is printed in a single stroke without any need for a scanning movement across the surface being printed, or with a scanning that is limited in relation to the longitudinal movement of the page.

Heads for parallel or serial-parallel type printers are generally manufactured with various ejector modules set side by side. It is in fact difficult to produce—with an acceptable yield—large-size chips or single units that are defect-free and can define all the nozzles in the parallel printing area. In addition, the heads in a single unit could not draw advantage from the ink feed simplifications of today's serial heads, due to the weakening that would be caused by a large-size slot in the unit.

Ejector modules for parallel printers are of limited dimensions (½", 1") and are assembled on a common support in such a way as to obtain an aligned disposition of the nozzles like in a single unit. However other problems arise when this structure is chosen, such as, for example, that of the difficulty in setting integrated units side by side, due to presence of the ink delivery slots.

Recently, ink jet heads have been developed for serial printing with numerous nozzles extending over a consistent part of the ejection module and suitable for simultaneously printing a large number of dots along the printing area and/or on various printing lines. These extensive heads are also mechanically weak, are complex to manufacture and many of the structural problems remain unresolved.

SUMMARY OF THE INVENTION

The main object of the present invention consists in producing ink jet printheads, primarily though not exclusively for parallel or serial-parallel type printers, without the drawbacks mentioned above, with a high degree of integration and requiring low production times and relatively low costs.

Another object of the invention is to define a process for manufacturing ink jet printheads in which the ink feeds the ejection cells through common delivery channels that do not detract from the robustness of the ejector modules and of the relative functional components.

Another object of the invention is to produce units for ink jet printheads with nozzles arranged aligned along a direction parallel to the line of print, of low dimensions and costs and which can provide good printing resolution.

Yet another object is to produce an ink jet head for parallel or serial-parallel printers, of low dimensions and cost.

These objects are achieved by the parallel or serial-parallel printing device and by the manufacturing process of the invention according to the characteristic parts of the main claims.

The characteristics of the invention will become clear from the description that follows, provided by way of non-restrictive example, with reference to the accompanying drawings, in which.

Figure 6:
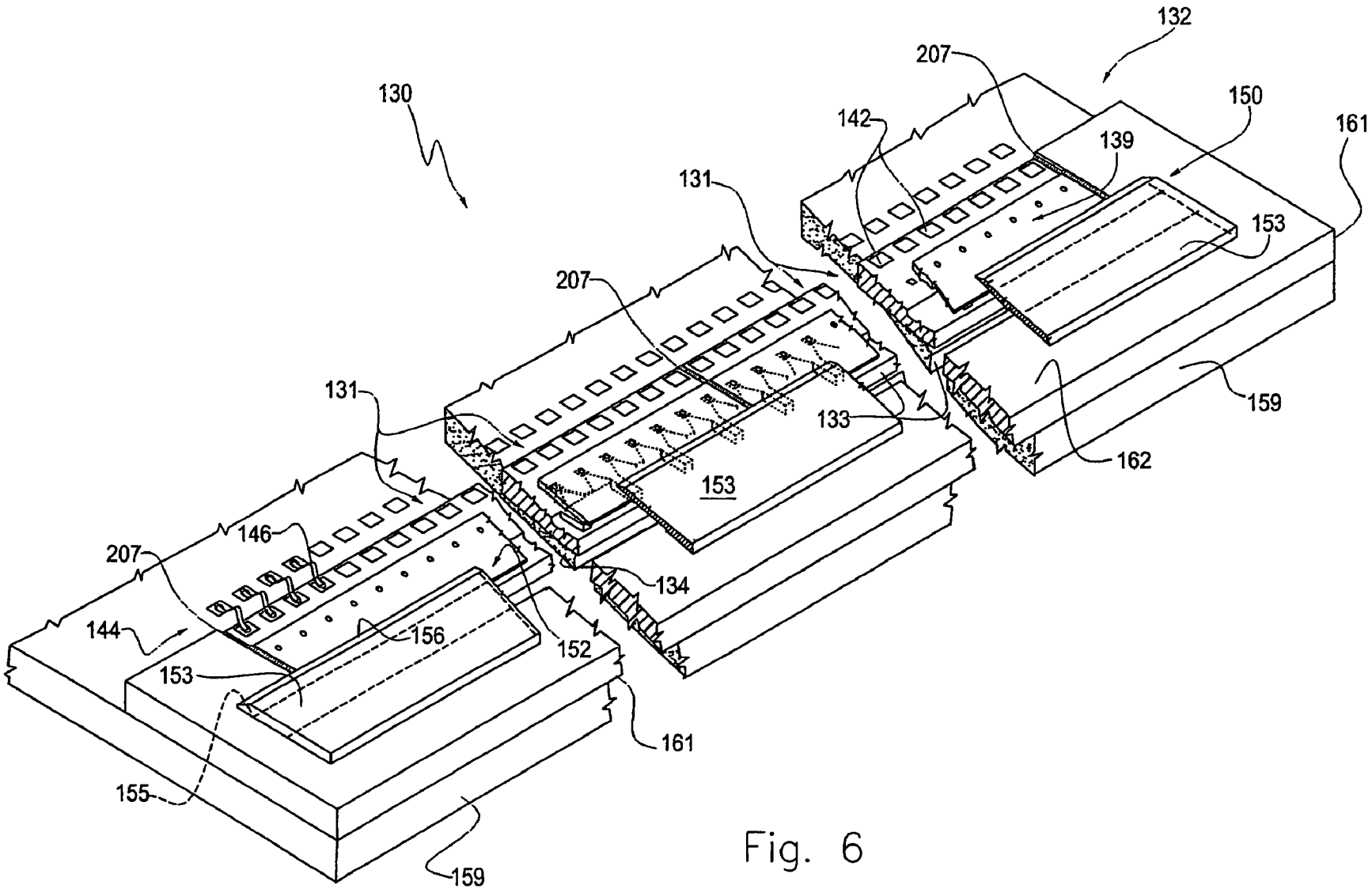
FIG. 6 represents a schematic, cross-section view of an ink jet printhead with numerous ejection modules, according to a first embodiment of the invention.
Figure 7:
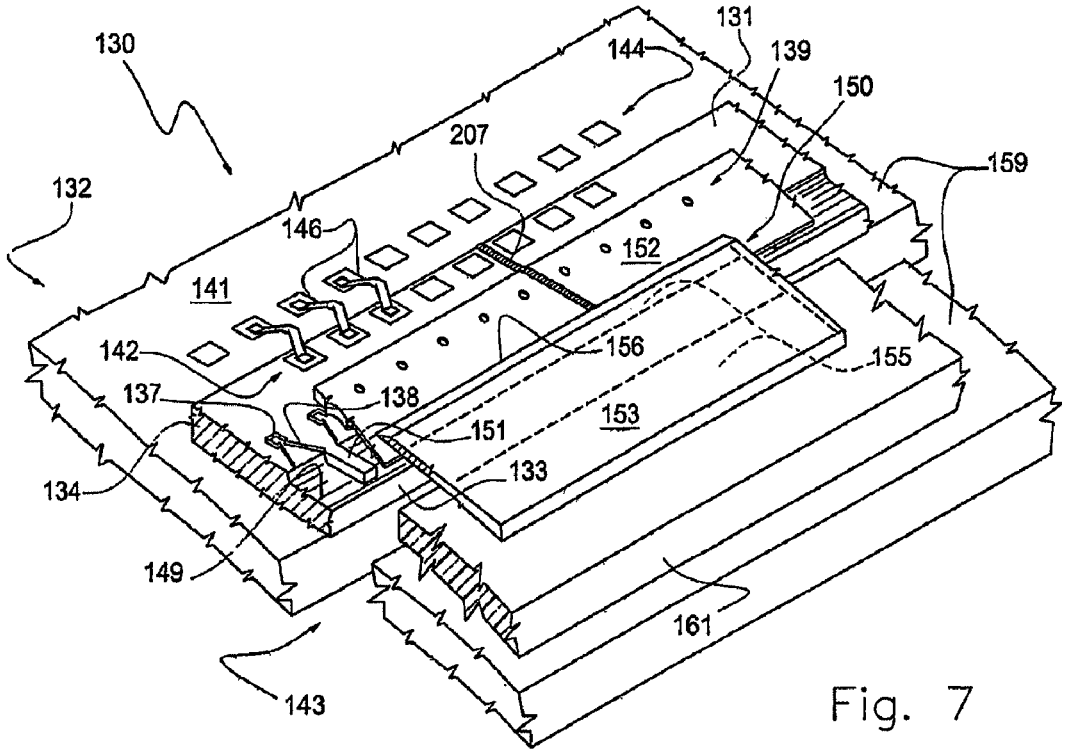
FIG. 7 shows enlarged details of the head of FIG. 6.
Figure 27A:
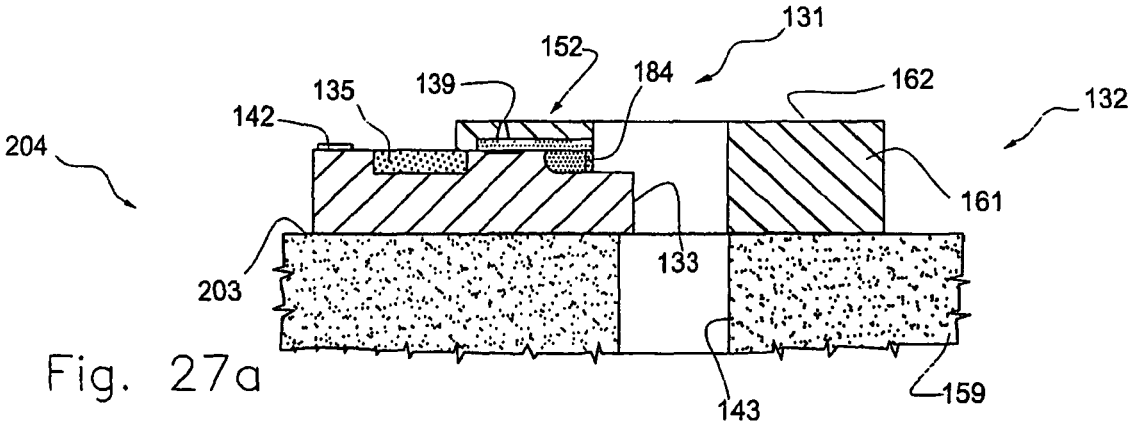
Figure 27B:
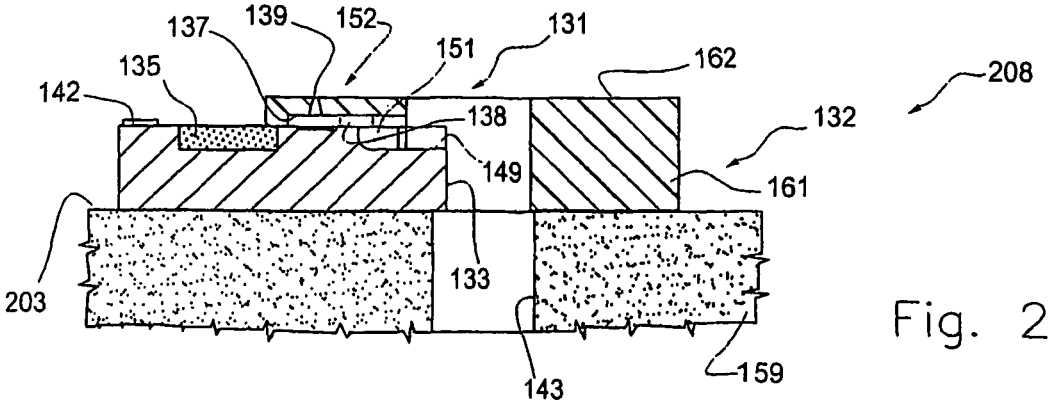
Figure 28:
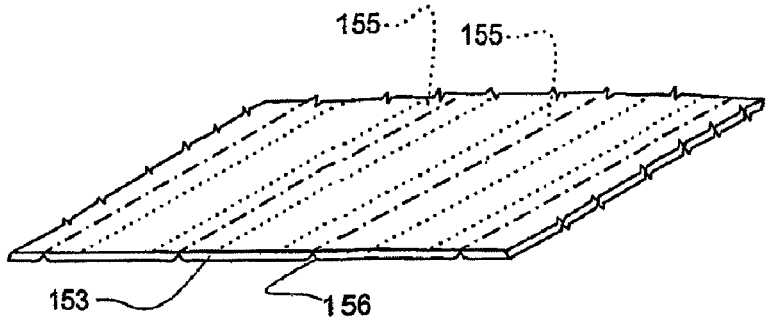
Figure 29:
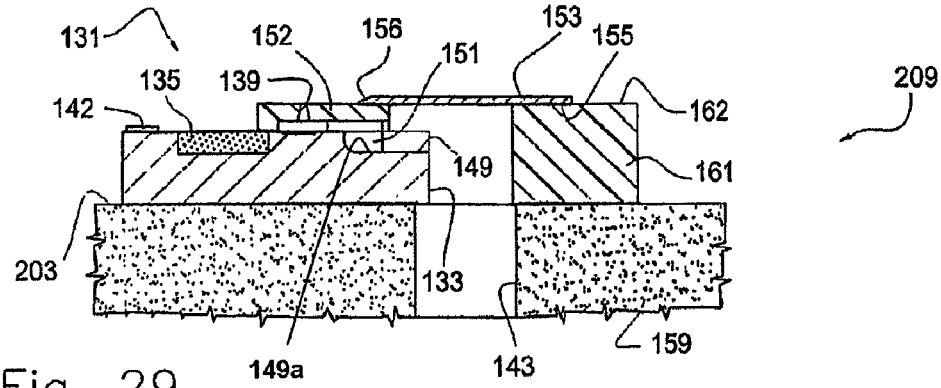
Figure 30:
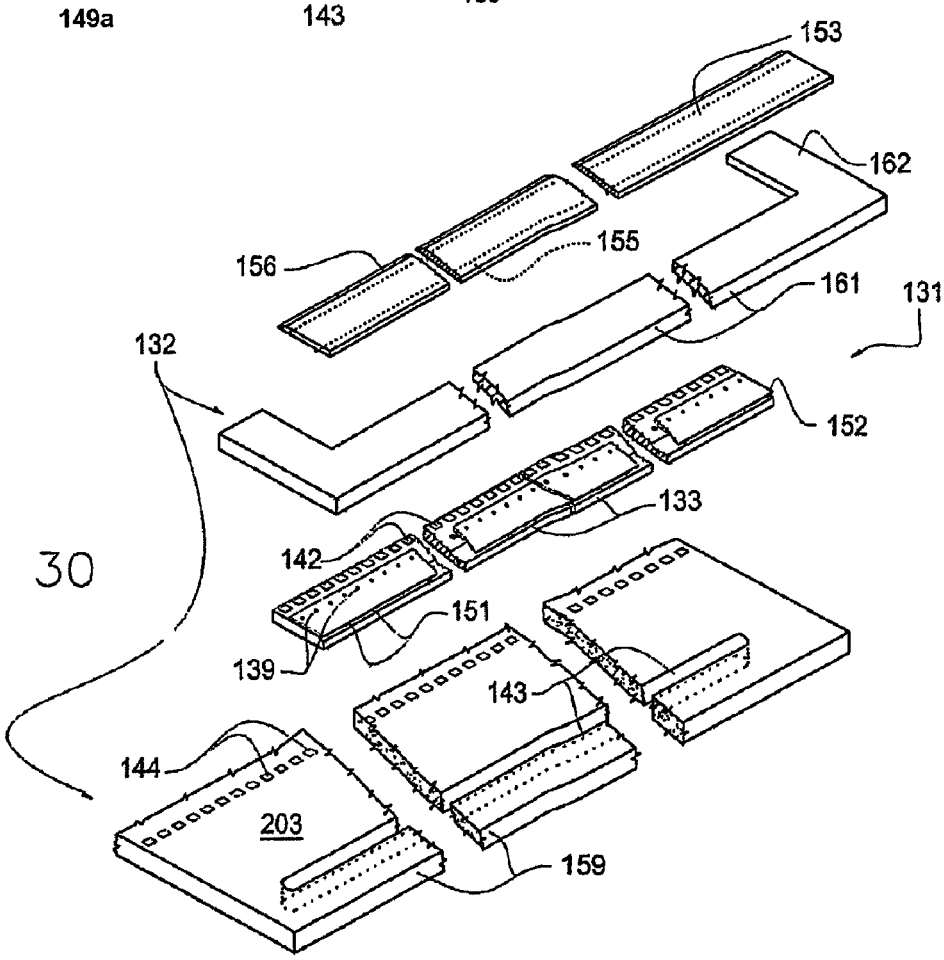
Figure 31:
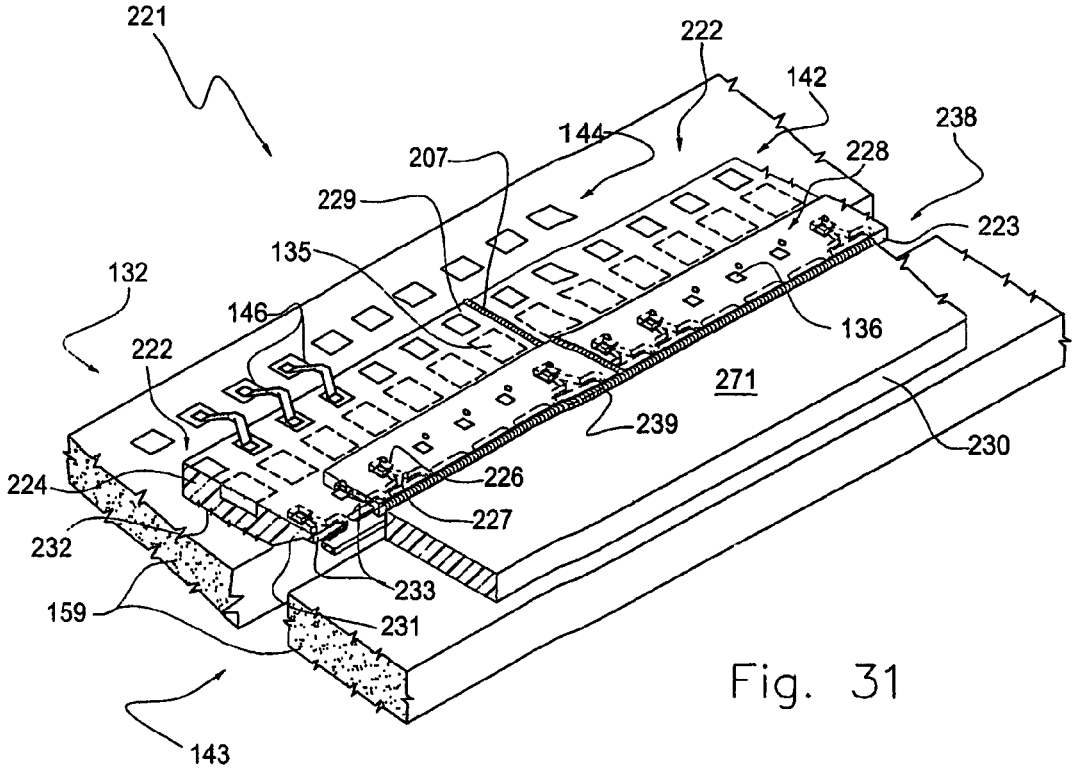
Figure 32:
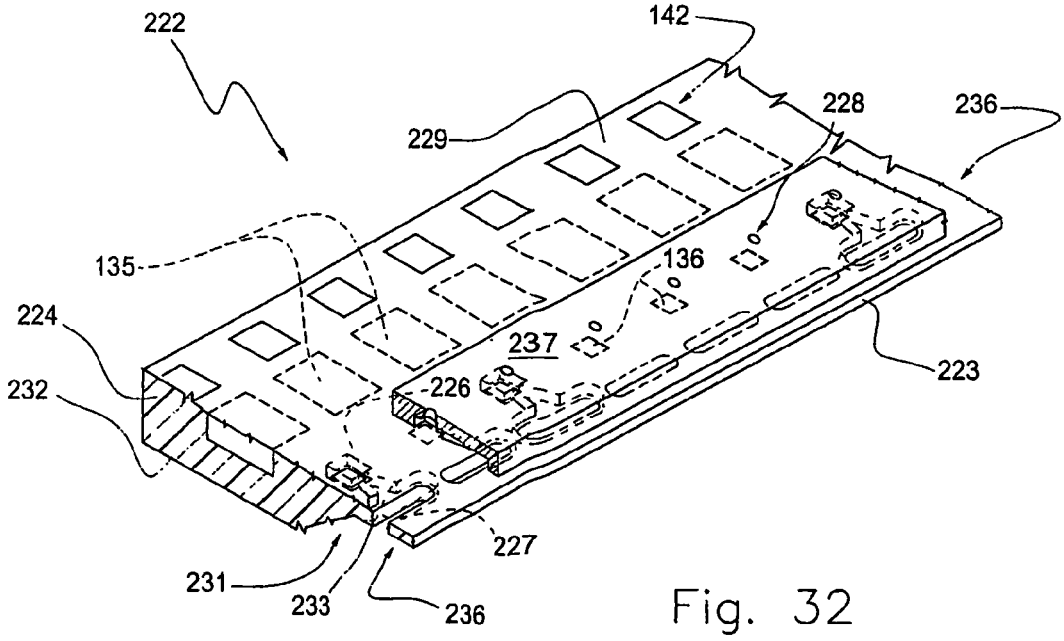
Figure 33:
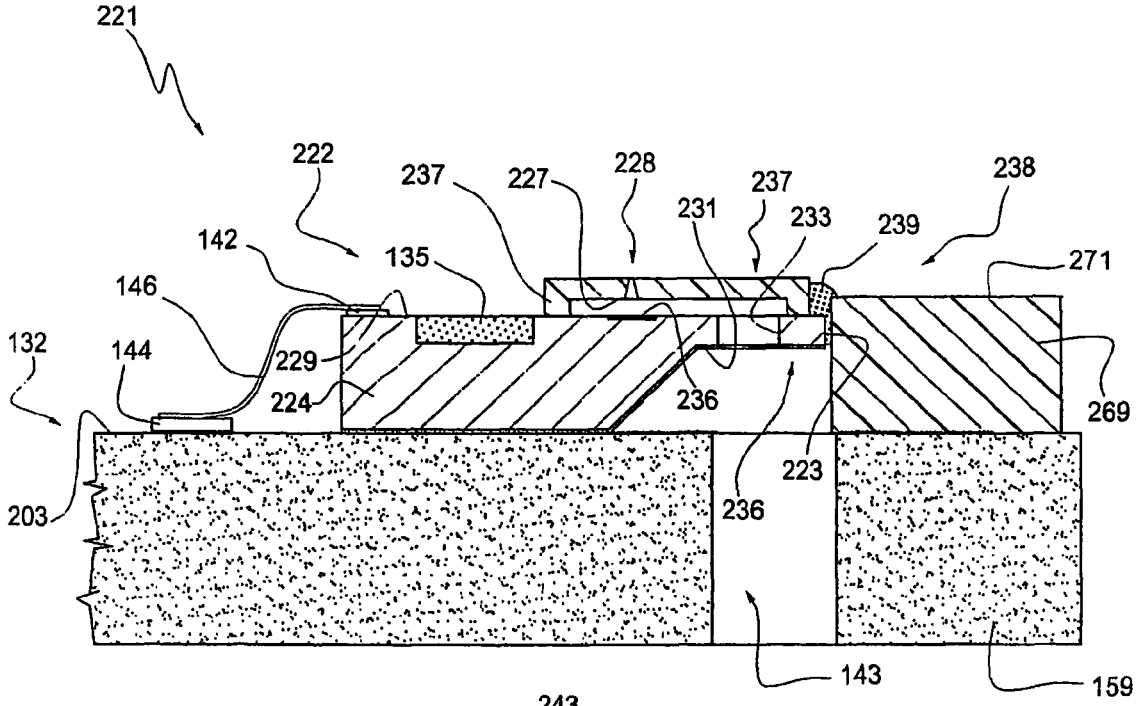
Figure 34:
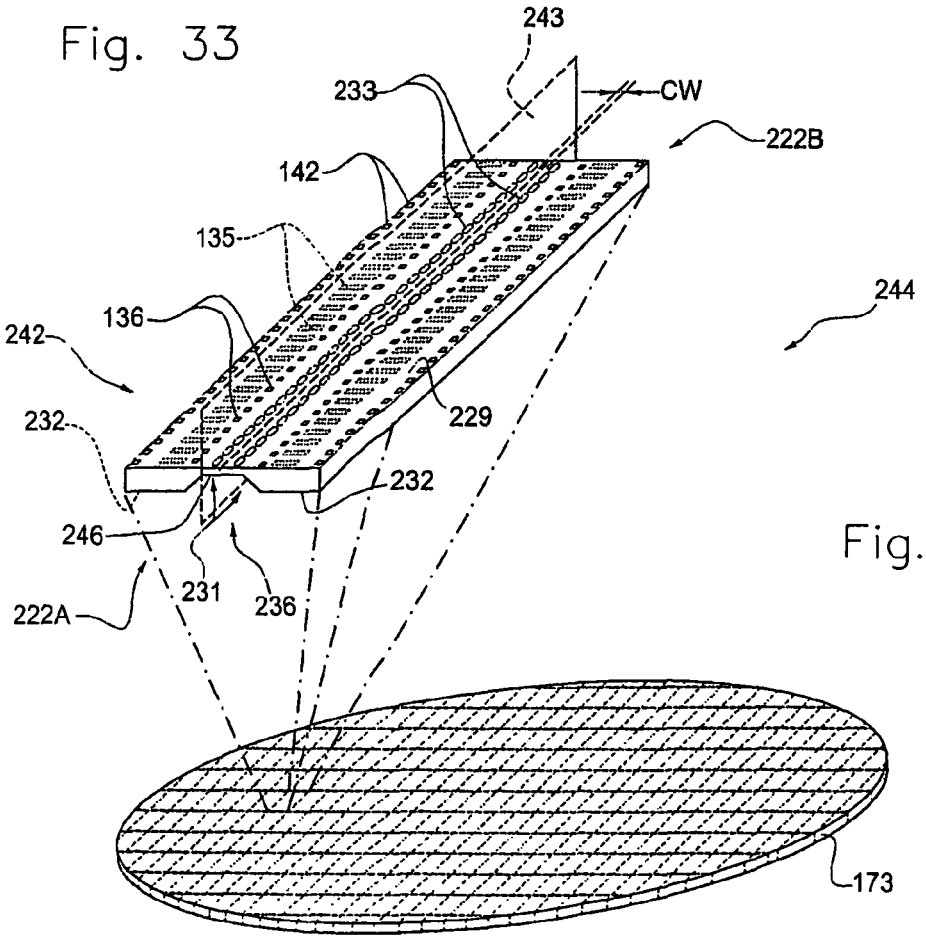
Figure 35:
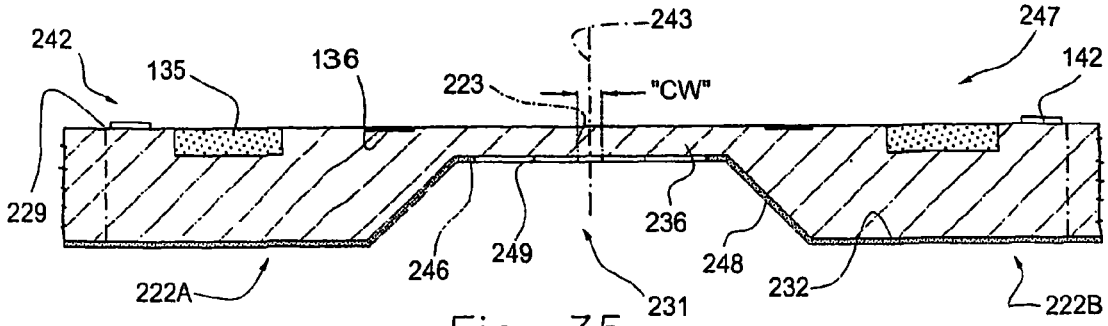
Figure 36:
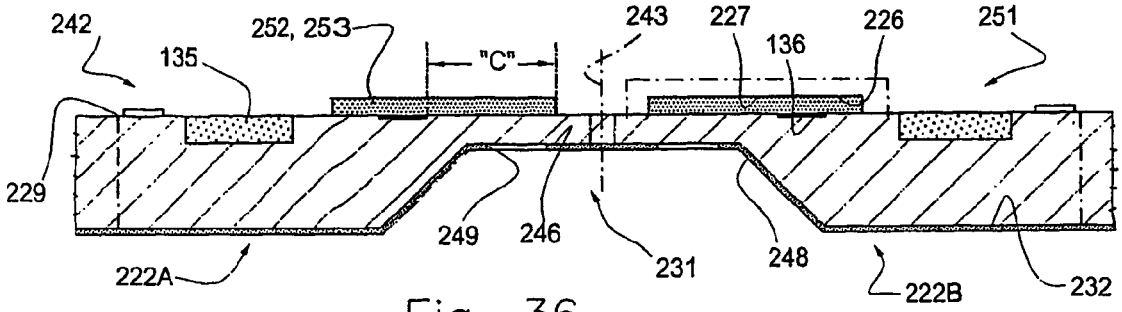
Figure 37:
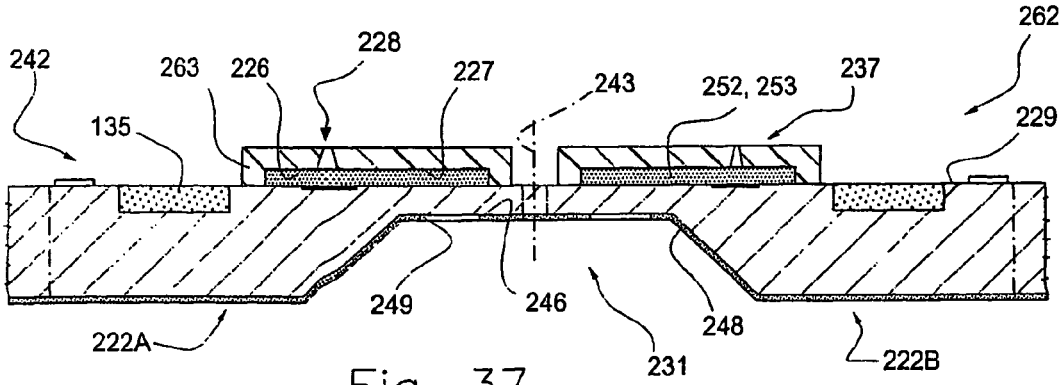
Figure 38:
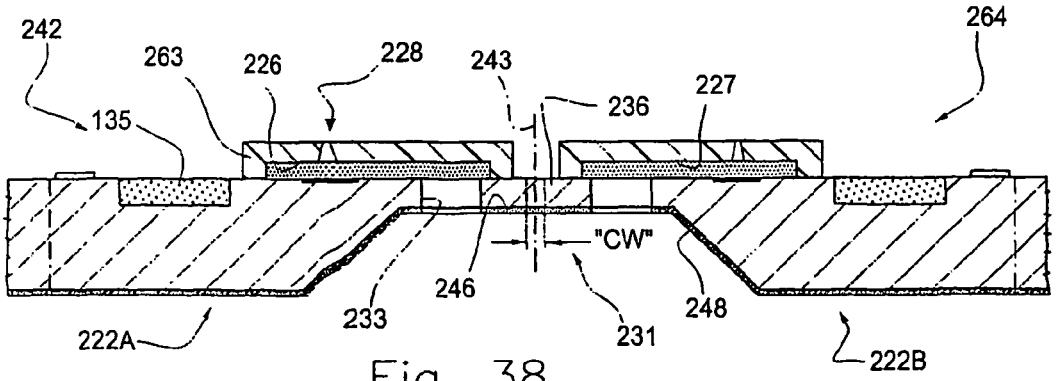
Figure 39:
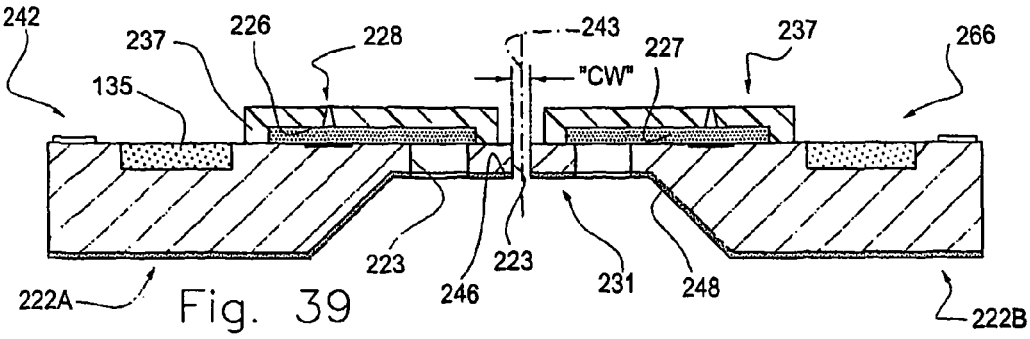
Figure 40A:
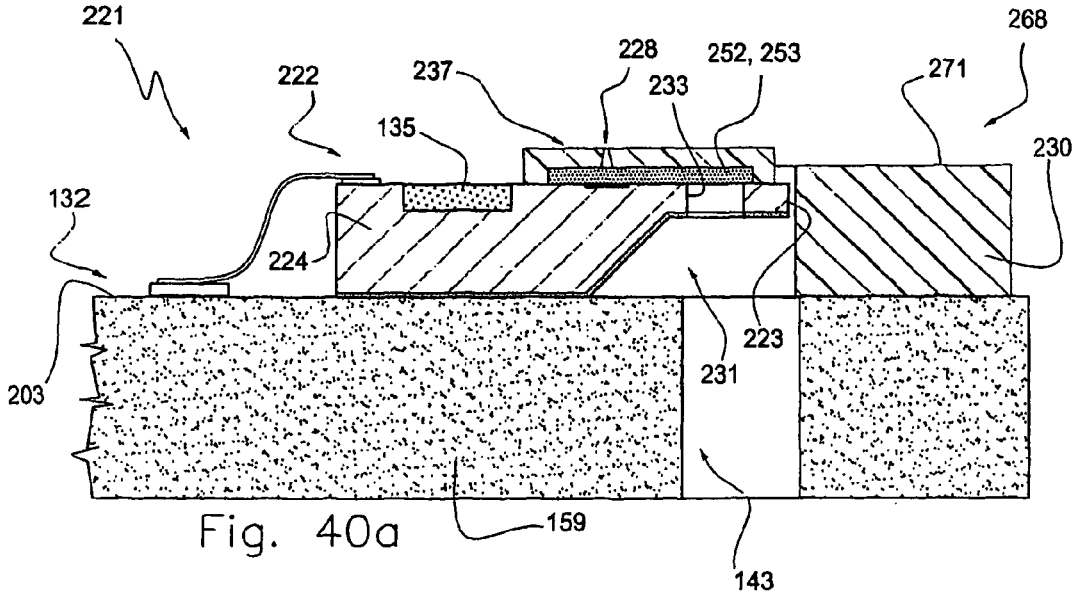
Figure 40B:
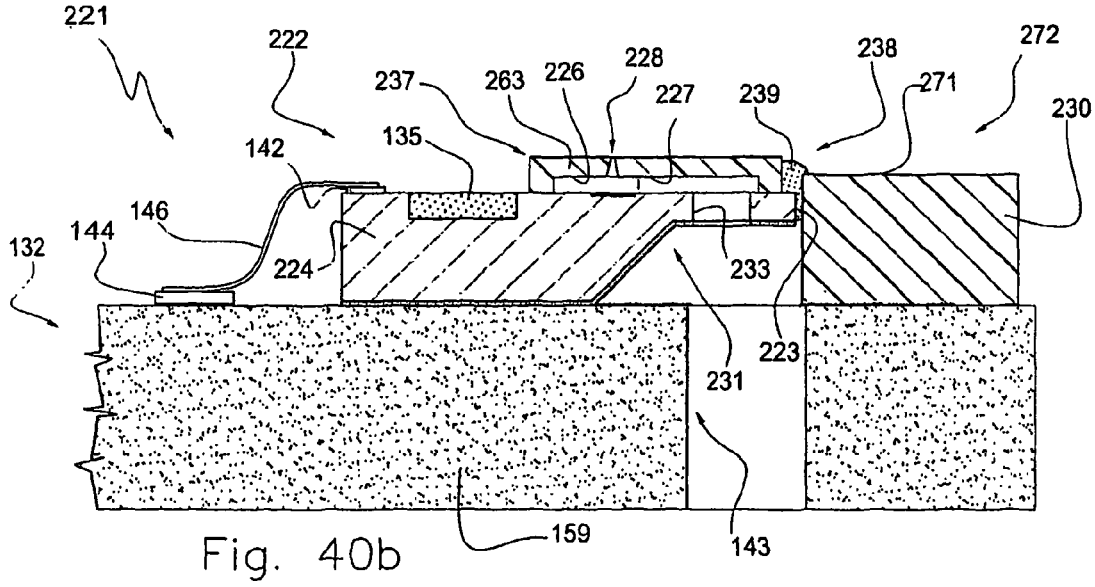

FIGS. 27*a* and 27*b* represent a schematic section of the printhead according to the invention in particular stages of manufacture;

FIG. 28 shows a view of a component during manufacture of the printhead according to the invention;

FIG. 29 represents a schematic section of the printhead according to the invention in another stage of manufacture;

FIG. 30 shows an enlarged view of parts of the head of FIG. 6;

FIG. 31 shows details of an ink jet printhead in accordance with a second embodiment of the invention;

FIG. 32 represents an axonometric schematic section, in enlarged scale, of an ejection module of the head of FIG. 31;

FIG. 33 shows a partial schematic section of the head of FIG. 31;

FIG. 34 represents a wafer of semiconductor material with head modules of the embodiment of FIG. 31;

FIGS. 35-39 represent schematic sections of the head module of FIG. 32 in successive stages of manufacture according to the invention; and FIGS. 40*a* and 40*b* represent a schematic section of the printhead according to the invention in particular stages of manufacture.

DESCRIPTION OF THE INVENTION

Figure 1:
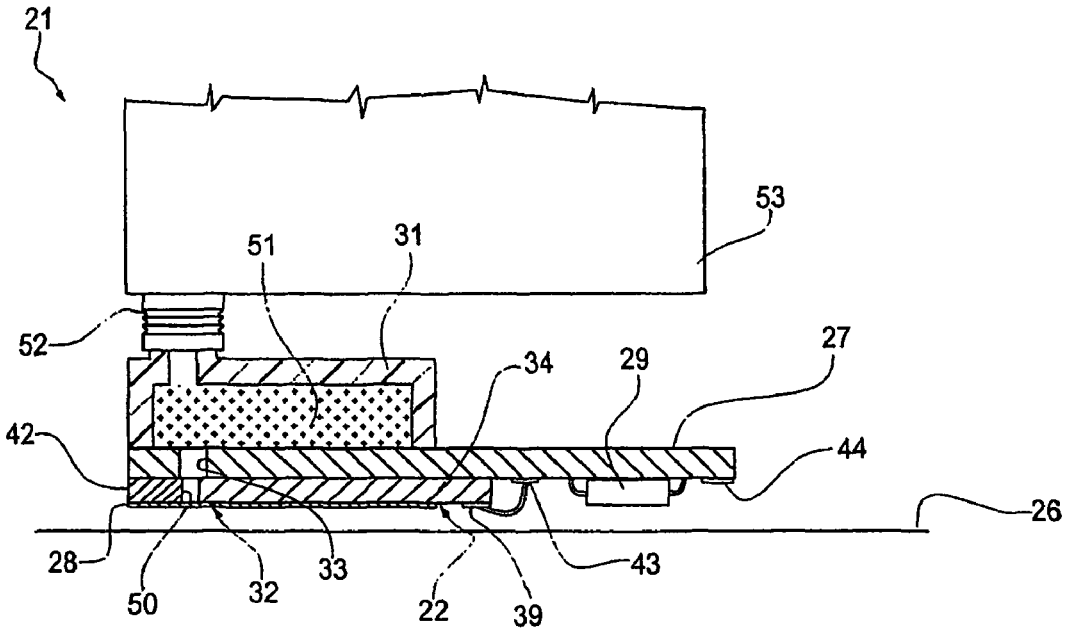
FIG. 1 is a schematic section of a printer with an ink jet printhead operating in parallel mode.

Depicted upside down in FIG. 1 with numeral 21 is a serial-parallel type ink jet printing device. This device has been described in the Italian patent application TO 2002 A 000876, filed on Oct. 10, 2002 on behalf of the same applicant.

Figure 2:
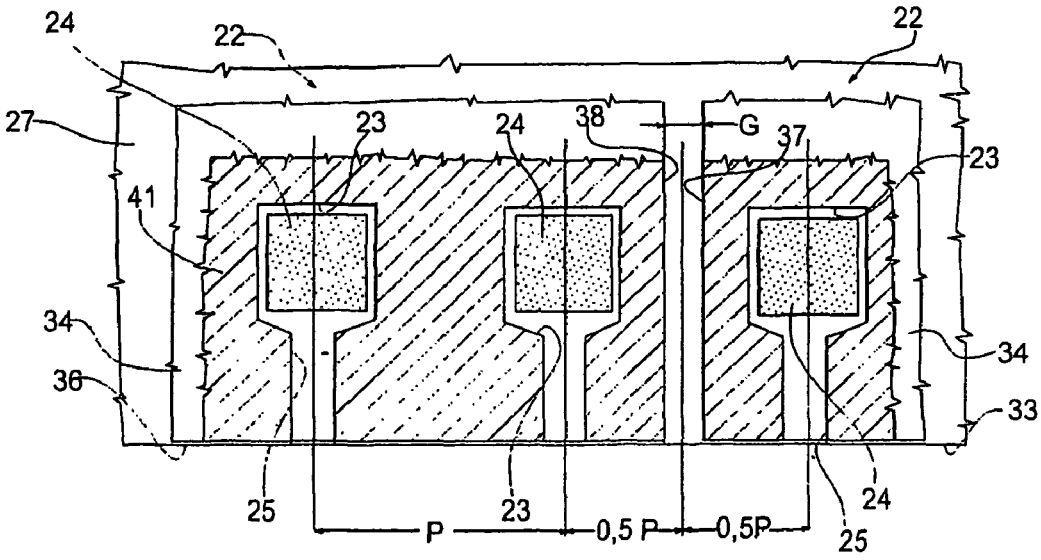
FIG. 2 is an enlarged scale view of a cross-section particular of a component of the head of FIG. 1.

In short, the device 21 comprises a plurality of ejector modules 22 parallel to the line of print. Each module is provided with ejection cells or chambers 23 (see FIG. 2), resistors 24 for commanding the ejection of ink on a sheet 26 and delivery channels 25.

The device 21 also comprises a board 27, an orifice plate 28, a chip driver 29 for selecting and driving the modules 22 and an auxiliary tank 31 for the ink. The board 27, the plate 28 and the tank 31 are common to all the modules 22. Made on the plate 28 are ejection nozzles 32 disposed aligned in a line parallel to the line of print.

The board 27 is of a rigid, isolating material has a support function for the modules 22 and includes a feed channel for the ink, defined by a slot 33, which traverses its thickness and is connected to the tank 31. Also mounted on the board is the chip driver 29. Alternatively, this could be implemented through integrated circuits in the single modules 22.

The modules 22 are mounted side by side on the board 27, with the cells 24 in connection with the slot 33 through the relative delivery channels 25, in a hydraulically tight connection through the plate 28.

The board 27 extends over the entire length of the print row or at least over a good part of it and the slot 33 extends all along the board, again parallel to the line of print.

Each module 22 consists of a chip 34 of crystalline silicon, rectangular in shape, with a front 36 and sides 37 and 38. The components making up the driving and selecting circuits are made on the chip 34, using known processes. The layers relative to the resistors 24 and the interconnections, not shown in any drawings, I/O pads 39 and a photosensitive resin film 41 are then deposited. Built in this film are the ejection cells 23, aligned with the corresponding resistors 24 and the delivery channels 25.

The ejector modules 22 are mounted on the base board 27 by gluing and pressing. Also glued on the board 27, adjacent to the edges of the modules 22, is a datum frame 42, of the same thickness as the modules 22 themselves.

The plate 28 is mounted on the modules 22 and on the datum frame 42 in such a way that the ejection nozzles 32 are exactly facing the ejection cells 23 and the respective resistors 24. It acts as an upper fluid sealing cover for the cells 23, for the delivery channels 25 and for the ink feeding channel.

In chip 34, the cells 23 and the resistors 24 are arranged parallel to the front 36 adjacent to the edge, the I/O pads 39 along the opposite front and the active components in the central part. The channels 25 are fairly short and guarantee a high operating frequency.

The cells 23 and resistors 24 have a pitch "P" equal to the pitch of the nozzles 32, whereas the distances between the sides 37 and 38 and the axes of the terminal cells 23 are a little less than "0.5 P", thus permitting a space "G" to be left between the sides 37 and 38 of two adjacent modules 22 during assembly of the board 27, accordingly guaranteeing alignment and constancy of the pitch "P" between the cells of the two modules.

The board 27 is substantially rectangular in shape, bounded by flat and parallel opposite surfaces and can be cut by an electrically isolating, chemically inert, rigid sheet, with thermal expansion coefficient close to that of the crystalline silicon. The slot-like aperture 33 can be obtained without any restrictions of precision due to the absence of delicate components. It can be made using any one of the methods known in the art. In the case of alumina or ceramic, the slot can be obtained by moulding before baking.

Metallic layers are deposited on the board 27 to produce soldering pads 43 and 44, interconnection tracks and I/O pads for the hard-wire connection of the printer, not shown in any of the figures.

The datum frame 42 is of the same thickness as the module 22 and is of a shape that is complementary to that of the ejector modules 22 mounted on the board 27 and such as to be side by side, wholly or in part, with the side 37 of the first module and with the edge 38 of the last module 22.

The datum frame 42 is at a distance from the fronts 36 in such a way as to form a reserve ink cell 50, communicating with the slot 33 and, through a channel 25 of the film 41, with the ejection cells 23. The thickness of the datum frame 42 is equal to that of the modules 22 and ensures that the respective upper surfaces form a flat surface, to facilitate the gluing to seal the orifice plate 28 (FIG. 1).

The orifice plate 28 can be made of "Kapton" or, alternatively, of gold-plated nickel and made by electroforming.

The auxiliary tank 31 is disposed on the surface of the board 27 opposite that on which the modules 22 are mounted. The tank 31 is filled through a sponge 51 and is connected through a joint-filter 52 with a removable type ink cartridge 53.

The joint-filter 52 and the flat cable permit the whole consisting of the modules 22 and the base board 27 to move transversally with respect to the sheet 26, while the cartridge 53 remain motionless. The latter may be replaceable, as in the refillable serial print units.

The device 21 has numerous advantages, economic and functional, over the known type parallel or serial-parallel printing devices. The delivery channels 25 are sufficiently short for optimal fluidic impedance in feeding of the ink to the cells 24, thereby ensuring high operating frequency of the modules 22.

The device 21 is also useful for ejection modules not integrated with nozzles. However, it needs precision positioning of the layer of nozzles to guarantee a sufficient precision of alignment and tightness for the individual cells 23 and for the individual channels 25 of the modules 22.

Figure 3:
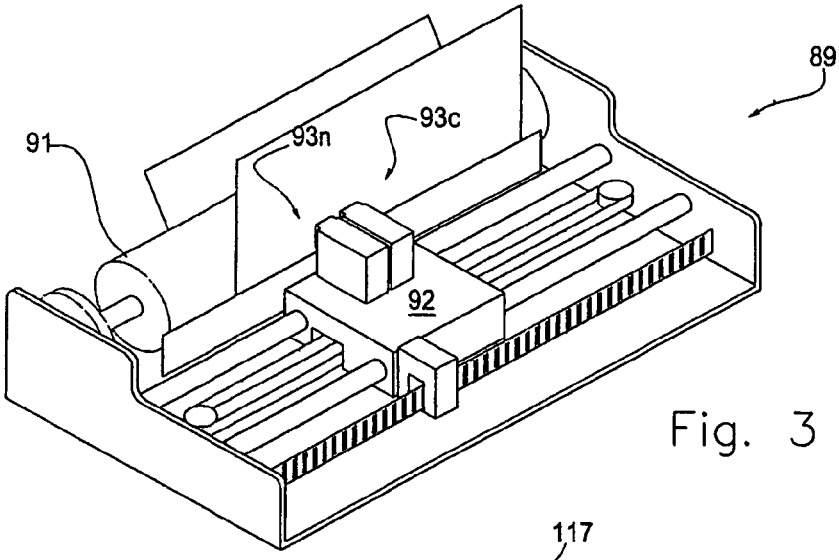
FIG. 3 shows a schematic view of a printer with an ink jet head operating in serial mode, according to the known art.

Shown in FIG. 3 is a serial type, ink jet printer 89, with a fixed structure, a contrast roller 91, a carriage 92 and two heads 93*n* and 93*c*, monochromatic and colour respectively.

Figure 4:
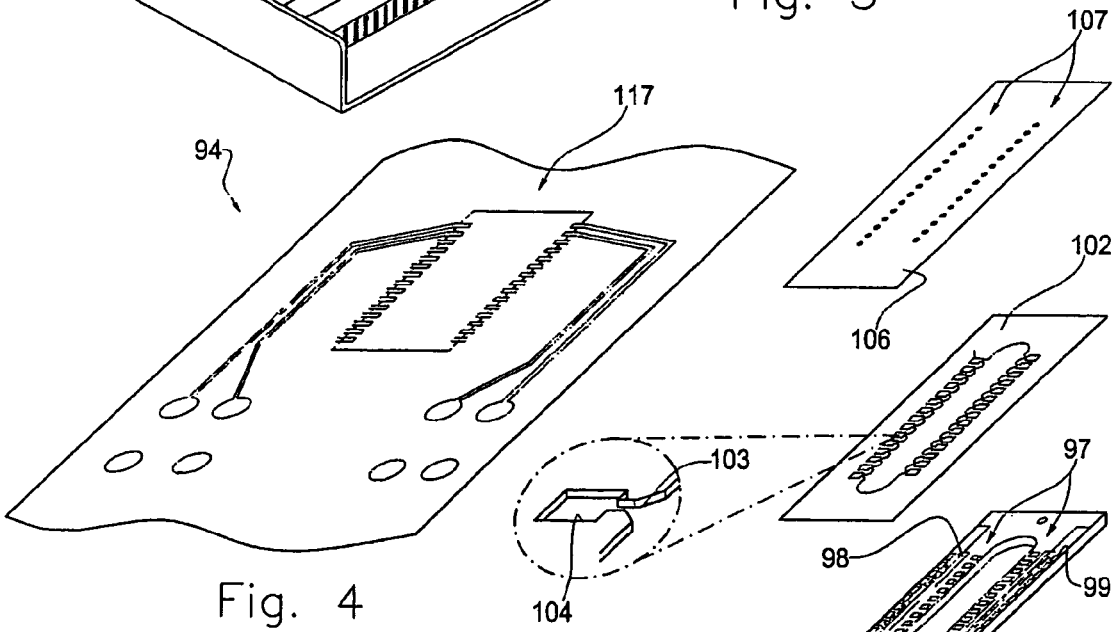
FIG. 4 is an enlarged schematic view of parts of an ink jet head for the printer of FIG. 3.

The head 93*n* (FIG. 4) comprises an ejection module 94 including a substrate chip 96 of semiconductor material (Silicon) with resistors 97 for ejection of the ink droplets, driving circuits 98 for the resistors 97 and pads 99 for the connection to an electronic controller not shown in the figure. Also made in the chip 96 is a pass-through slot 101 through which the ink flows from a tank, not shown in the figure either.

On the upper surface of the chip 96 is a layer 102 of photopolymer in which delivery channels 103 and ejection cells 104 are made, using photolithographic techniques, in correspondence with the resistors 97. An orifice plate 106, generally made of a lamina of gold-plated nickel or Kapton, bearing nozzles 107 above the cells 104, is glued on to the photopolymer 102.

The nozzles 107 are arranged in two parallel lines, staggered among each other by a half pitch, to double the resolution of the image in the head scanning direction. The circuits 98 are produced according to a simplified C-MOS/LD-MOS technology, of low dissipation power and with a specific solution for each head model.

Figure 5:
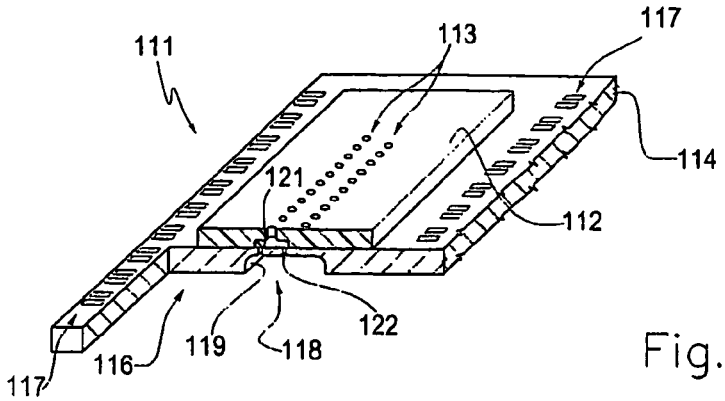
FIG. 5 shows a view of parts of another type of head for the printer of FIG. 3.

An ejection module 111 for a monolithic, serial ink jet printhead is shown in FIG. 5, a type known, for example, from Italian patent no. 1.310.099 filed on behalf of Olivetti Lexikon S.p.A., comprising a structural layer 112 with two lines of nozzles 113 and a silicon substrate chip 114. The chip 114 comprises microelectronics 116, solder pads 117 and microhydraulics 118 partly in common with layer 112.

The manufacturing process of the module 111 includes the production of a wafer, not shown in any of the drawings, consisting of a plurality of chips 114 on which the microelectronics and the microhydraulics are made and completed.

A channel or distribution tank 119 is made in the lower part of the chips 114 by dry etching and, through layers of sacrificial photopolymer, ejection cells 121 are formed in the upper part of the chip and delivery channels 122 for the ink between the channel or tank 119 and the cells 121.

The structural layer 112 includes an integrated lamina, which is deposited on the chip 114 and on which the nozzles 113 are later made. Finally the sacrificial layers relative to the cells 121 and the channels 122 are eliminated.

The module 111 presents optimal fluidic impedances for feeding of the ink, low manufacturing costs and guarantees fluid tightness for the various sections making up the head microhydraulics.

As already mentioned, the structure and process relative to the module 112 cannot be used to make modules extending to the width of the page or a good part of it. Wafers of excessive dimensions would be required, with high waste levels. In addition, a head with a slotted module for the feeding of all the nozzles of the line of print would be fragile on account of being weakened by the slot itself.

First Embodiment

Shown in FIG. 6, indicated with the numeral 130, is an ink jet printhead, according to a first embodiment of the invention, comprising a series of ejection modules 131 and a support 132 on which to mount the modules 131, structurally similar to the head of the printing device 21 of FIG. 1.

Figure 8:
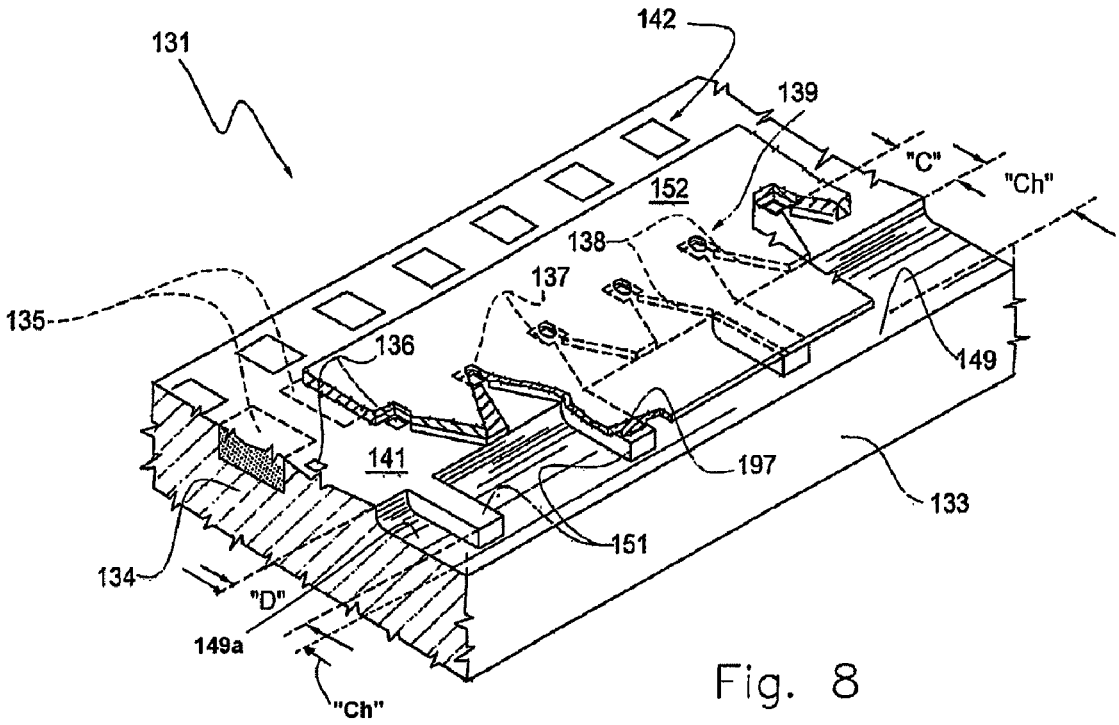
FIG. 8 is a cross-section schematic view, in enlarged scale, of an ejection module of the head of FIG. 6.
Figure 9:
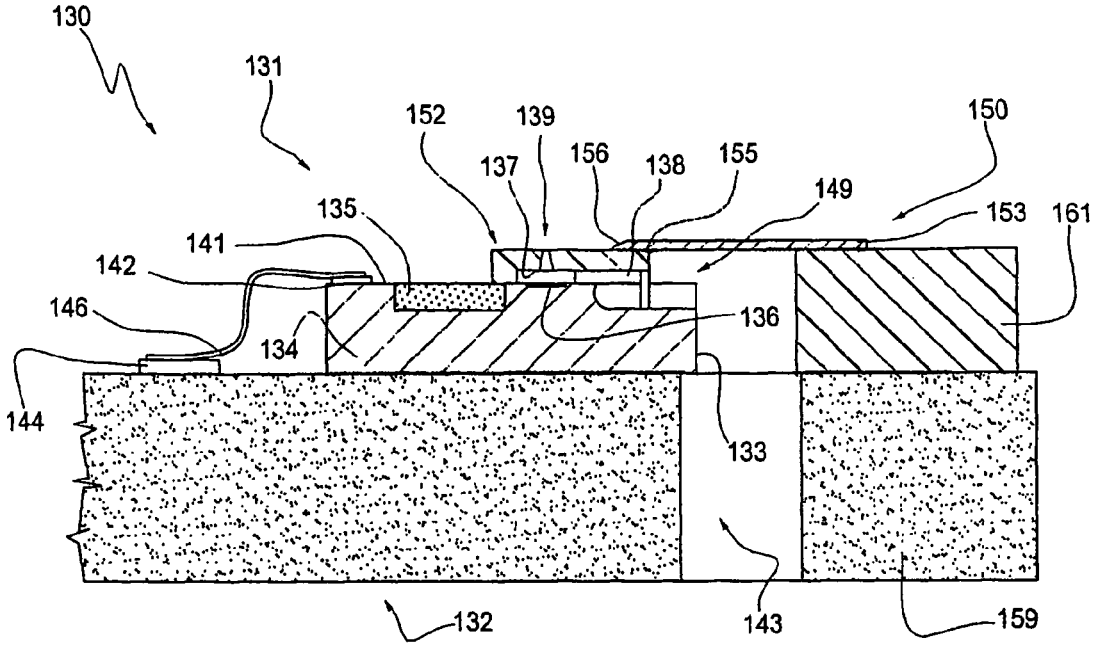
FIG. 9 is a partial schematic cross-section of the head of FIG. 6.

Each module 131 has a substantially rectangular shape with a front 133 and comprises a substrate or chip 134 (FIG. 8) of crystalline silicon, including driving circuits 135, resistors 136, ejection cells 137, delivery channels 138 for the ink of the cells 136 and ejection nozzles 139.

The circuits 135 and the resistors 136 are integrated on a face 141 of the chip 134. Also deposited on the same face 141 are the solder pads 142 for the circuits 135.

The resistors 136 are arranged parallel to the front 133, a short distance from it and the cells 137 are formed above the resistors 136 and, together with the channels 138, are found upon the face 141. The channels 138 extend along an area bounded by the face 141, with an axis perpendicular to the front 133 and for a portion "C" on the end part of the resistors 136.

The support 132 (FIGS. 6, 7, 8 and 9) also defines a feeding duct 143 for the ink of the channels 138, consisting of a slot-like aperture identical to the slot-like aperture 33 of the device 21 of FIG. 1. Deposited on the support 132 are solder pads 144, connected via conductors 146 to the pads 142 of the modules 131 and solder pads, not depicted, for the connection of the head to the printer.

According to the invention, the head 130 comprises, in each module 131, a distribution channel 149 made in the chip 134 and an orifice plate 152 and sealing means 150.

The distribution channel or main distribution channel 149 extends over the entire length of the module 131 parallel to the edge 133 and adjacent to it and is in fluid communication with the delivery channels 138 and with the feeding duct 143 of the support 132. The orifice plate 152 is integrated on the face 141 of the chip 134, delimits the cells 137 and the channels 138 and the nozzles 139 are made upon it above the ejection cells 137. The sealing means 150 are inserted between the orifice plate 152 and the support 132 to ensure ink-tightness between the feeding duct 143 and the cells 137.

In the head 130 of this first embodiment, the distribution channel 149 is produced on the same face 141 of the chip 134 and ribs 151 are provided that run transversally in the channel 149 for a length "D" between the delivery channels 138 so to form a further distribution channel 149*a* orthogonal to the channel 149. The sealing means 150 in turn include a sealing lamina 153, providing tightness between the orifice plate 152 and the support 132.

Specifically, the chip 134 is ½" or 1" long, 1.5-2 mm wide and 0.4-0.7 mm thick. The resistors 136 are disposed 0.5-1.0 mm from the front 133 and the distribution channel 149 results from an etching in the face 141 10-100 μm deep, which starts from the distance "C" and extends for a width "Ch" of 0.3-1.0 mm, up to the front 133. The resistors 136 are powered by the circuits 135 of the chip 134, from ends opposite the duct 143.

Figure 12:
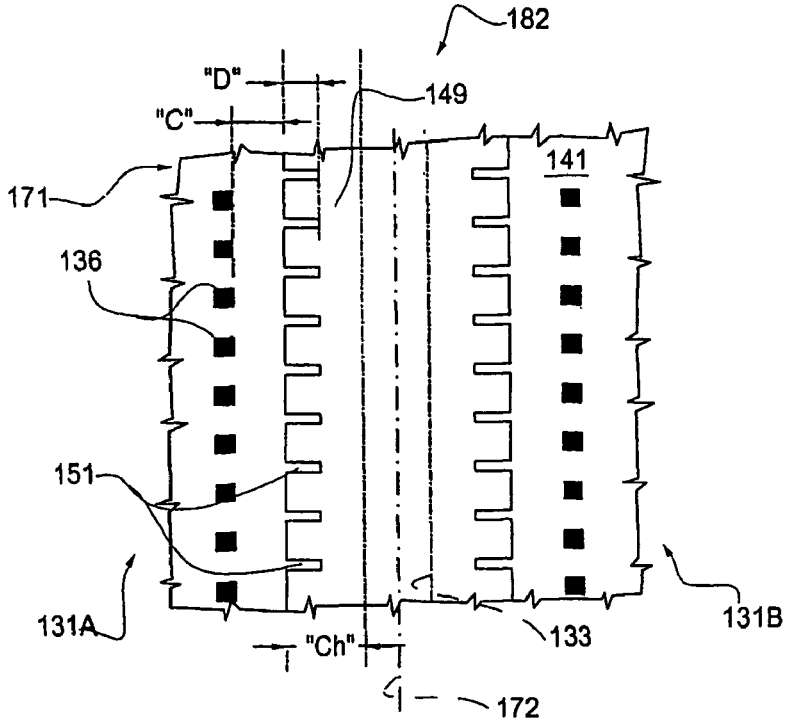
FIG. 12 is a partial plan view of the part of the unit of FIG. 11.
Figure 13:
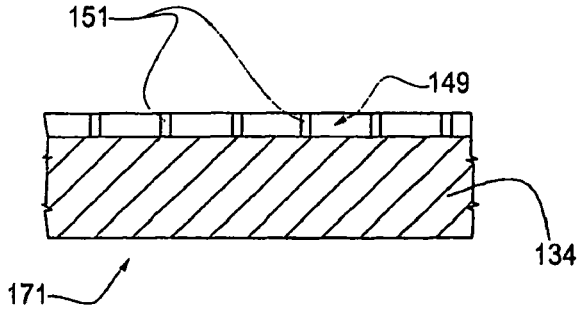
FIG. 13 is a partial longitudinal section of FIG. 12.
Figure 14:
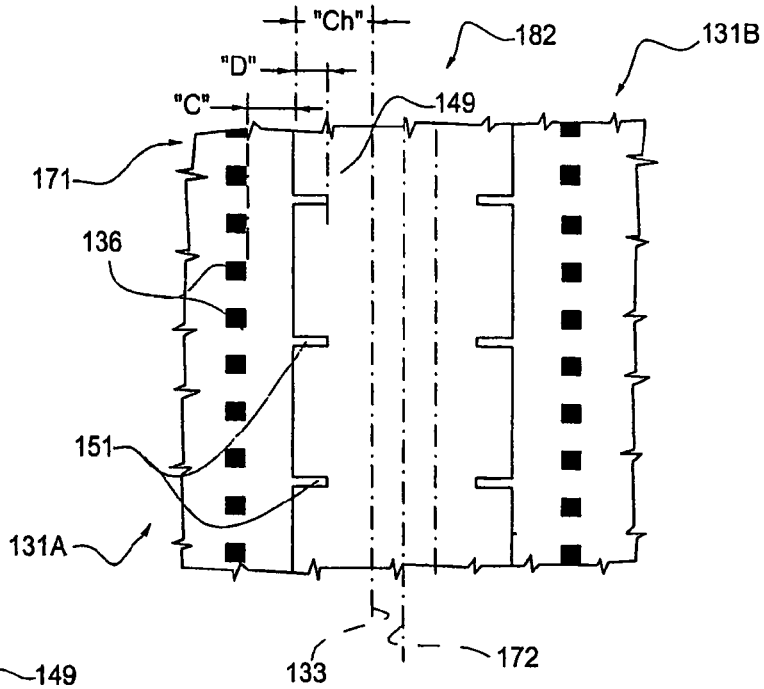
FIG. 14 illustrates a partial plan view of a variant of the part FIG. 11.
Figure 15:
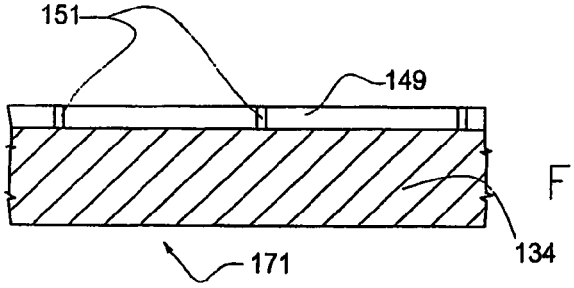
FIG. 15 represents a partial longitudinal section of FIG. 14.

The ribs 151, in pairs, may be inserted between a plurality of delivery channels 138, as shown in FIGS. 6, 7, 8, 14 and 15, or may be placed in correspondence with each channel 138, as shown in FIGS. 12 and 13.

The orifice plate 152, in the area in which hydraulic circuits are produced, is at a distance of 10-35 μm from the face 141 of the chip 134 and sets the height of the cells 137 and of the channels 138.

The sealing lamina 153 is made for instance of a lamina of resin, such as Kapton or of a metallic lamina, for instance gold-plated nickel, limited by a tapered edge 156. The lamina is secured to the orifice plate 152 by means of heat and pressure gluing, for instance through depositing an adhesive film 155 on a gluing area adjacent to the edge 156 and on a gluing area on the orifice plate 152 and in such a way that the edge 156 is parallel and adjacent to the nozzles 139.

The gluing areas of the lamina 153 and of the orifice plate 152 extend for a width that suffices to ensure that the cells 137 and channels 138 are provided with dependable fluidic sealing.

The ribs 151 are made as etches in the silicon and offer good contrast in the gluing operations between the lamina 153 and the layer 152, without substantially increasing the fluidic impedance of the hydraulic system between the cells 137 and the channel 149.

In particular, the ribs 151 extend for a distance "D" of 0.2-0.9 mm in the distribution channel 149; such a distance is shorter than "Ch" and the ribs are each 15-30 μm wide, while the gluing area of the layer 152 extends for slightly more than these values towards the nozzles 139.

The support 132 includes a board 159 of a rigid material, similar to the board 27 of FIG. 1, for instance of alumina, glass, PCB, upon which the pads for the connection to the modules and to the printer are deposited and which defines the feeding duct 143 through its thickness.

The ejector modules 131 (FIG. 6) are mounted side by side on the board 159 in such a way that the relative nozzles 139, the cells 137 and the fronts 133 are aligned. The disposition of the nozzles and the pitch "P" are the same as already described with reference to the cells 23 of the device 21 of FIG. 2 and according to the description in the already mentioned patent application TO 2002 A 000876.

A frame 161, for instance of a plastic material and similar to the datum frame 42 of FIG. 1, is mounted on the board 159 beside the modules 131 aligned with the fronts 133, with an upper surface 162 substantially flush with the upper surface of the nozzle layers 152. Alternatively, this function may be obtained from a step in the same board 159, adjacent to the duct 143.

The sealing lamina 153 is mounted to seal the surface 162 of the frame 161 or the upper surface of the step on the board 159 by heat and pressure gluing, for instance through another part of the adhesive film 155 on the edge of the lamina 153 opposite the edge 156.

Figure 10:
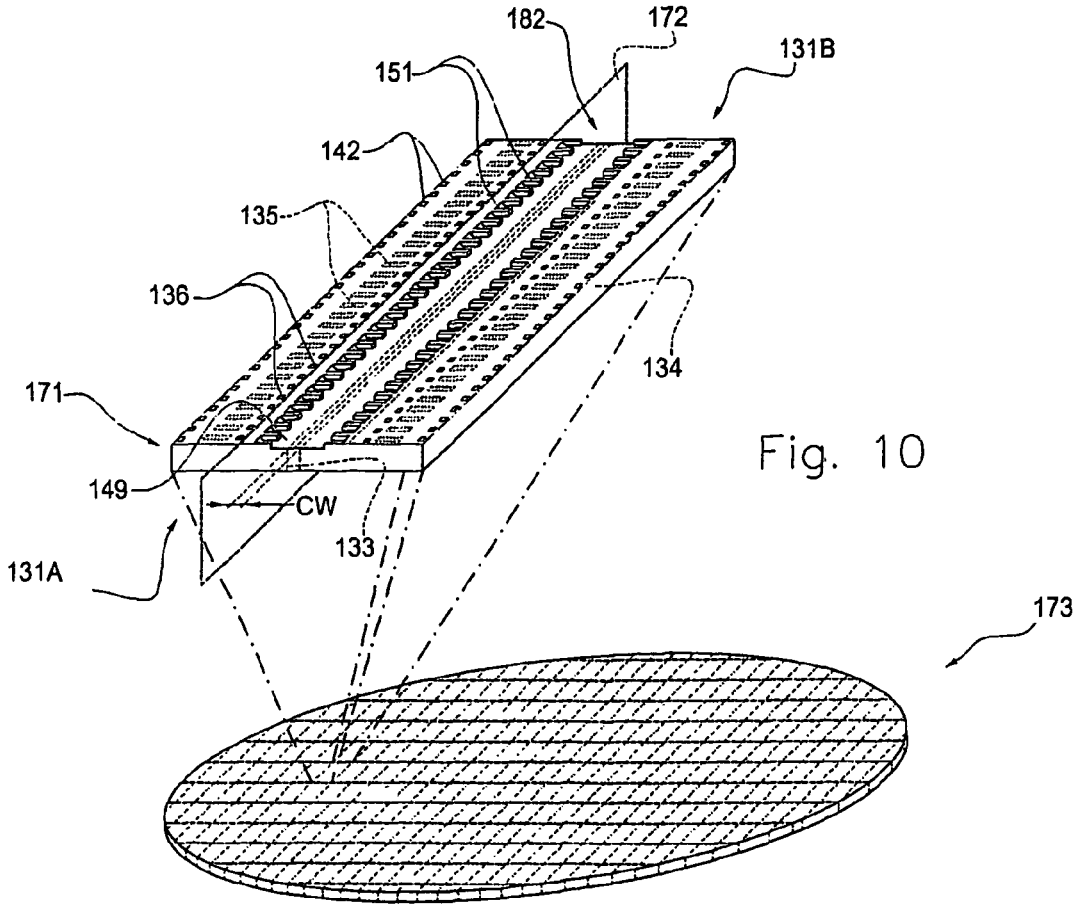
FIG. 10 illustrates a wafer of semiconductor material with parts of head modules in a first manufacturing stage of the invention.
Figure 11:
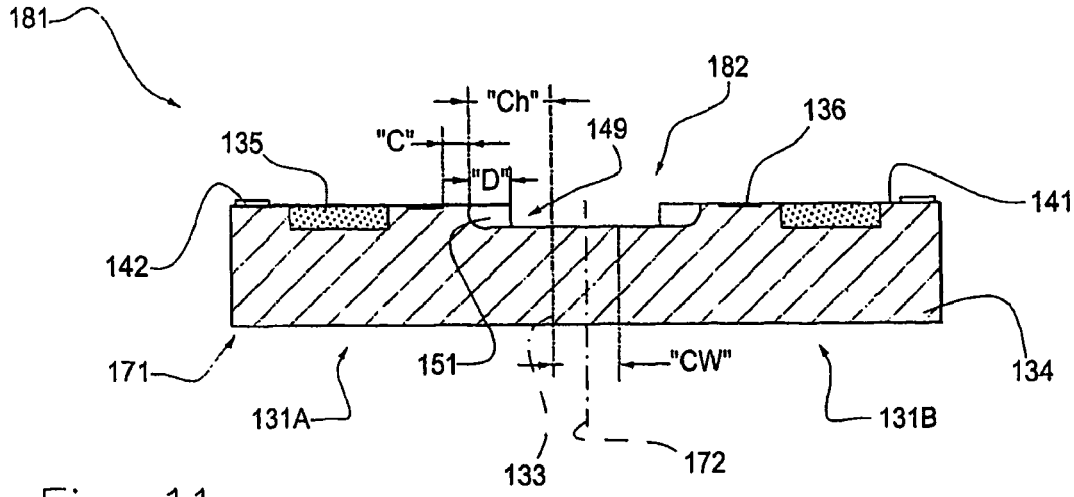
FIG. 11 is a section of one of the parts of the modules of FIG. 10.

With reference to FIGS. 10 and 11, the manufacturing process of the printhead 130 includes a phase of defining modules 131 arranged in pairs, indicated singly with numerals 131A and 131B, in a chip block 171. The block 171 corresponds to two chips 134 side by side, mirror-like, and integrates, on the upper face 141, the circuits 135 and the resistors 136, where the resistors are arranged parallel to a transversal reference plane 172 of the chip and the circuits 135, with respect to the resistors 136, are positioned on the end opposite that of the plane 172.

The chip block 171 represents one of numerous sections of a wafer of silicon 173 (FIG. 10). The circuits 135, resistors 136, interconnection and pads circuits 142 can be formed following a standard process. Work is performed directly on the wafer 173 until a complete ejector module is obtained.

From a single chip block 171, two ejector modules 131 are obtained at the end of the process. The block 171 is the same length as a single module 131 and is just over twice as wide. The two modules 131A and 131B (FIG. 11) are developed as mirror images of each other with respect to the reference plane 172 starting from the sides of the block 171 and are at a distance from each other such that a space "CW" is left for the cut to be made. The cut will also delimit the fronts 133 parallel to the plane 172.

The chip blocks 171 are compact and of limited dimensions and ensure an optimal cutting of the wafer 173, with minimum wastage. For chips 134 of ½", and wafers of diameter 150 mm, more than 500 modules 131 can be produced. Naturally, the modules 131 can be made from the wafer 173 with a single definition, by means of a layout in which the chips are simply set side by side.

The manufacturing process of the invention is advantageous for producing particularly extensive printheads, formed of various modules 131, parallel or serial-parallel type printers, but can also be employed to produce economic serial heads formed from a single module 131.

In accordance with the invention, the manufacturing process of the printhead 130 includes an etching step 181 (FIG. 11) wherein on the face 141 of each chip block 171 of the wafer 173 a longitudinal etch 182 is made. The etch 182 is symmetrical with respect to the plane 172, starts at a distance "C" from the resistors 136 and produces, in the sections 131A and 131B, the distribution channels 149 and the series of ribs 151 which extend for length "D" in the channels 149 so as to form the further distribution channels 149*a*.

Etching of the wafer 173 in the step 181 can be effected with known dry etching, such as Reactive lone Etching (RIE), or wet etching techniques with KOH.

Figure 16:
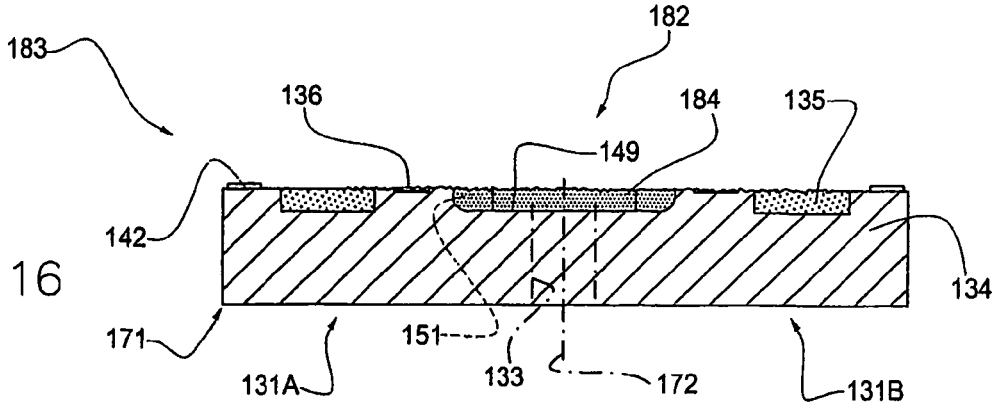
FIGS. 16-18 represent schematic sections of the head module FIG. 8 in successive stages of manufacture according to the invention.
Figure 17:
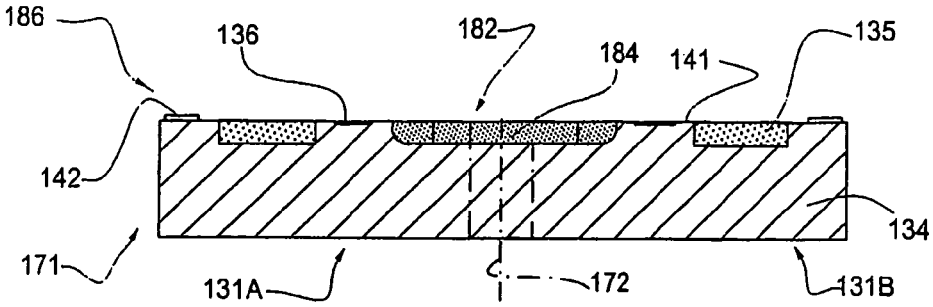
Figure 18:
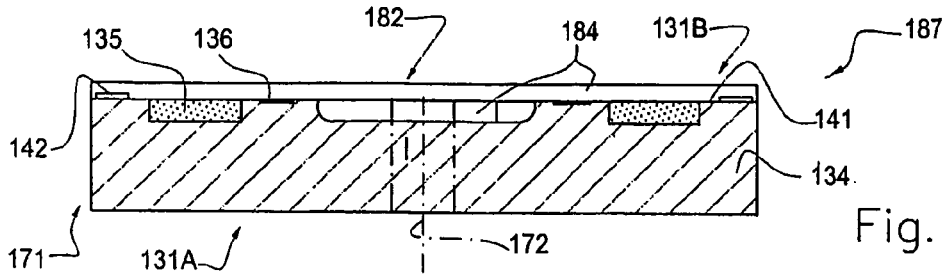
Figure 19:
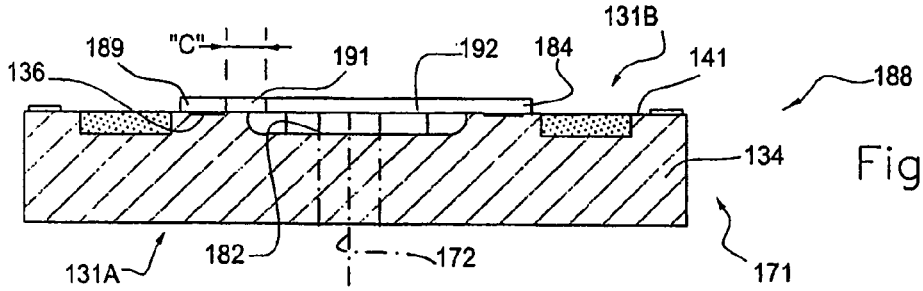
FIG. 19 illustrates a schematic section of the head module of FIG. 8 in a particular manufacturing stage of the invention.
Figure 22:
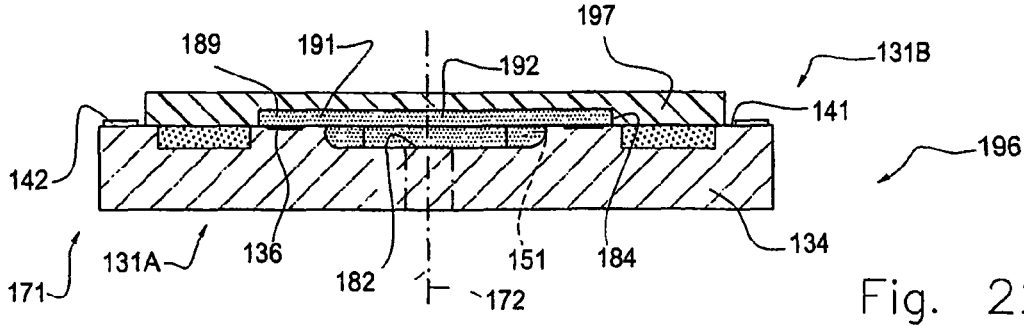
FIGS. 22-24 represent schematic sections of the head module of FIG. 8 in other stages of manufacture according to the invention.
Figure 23:
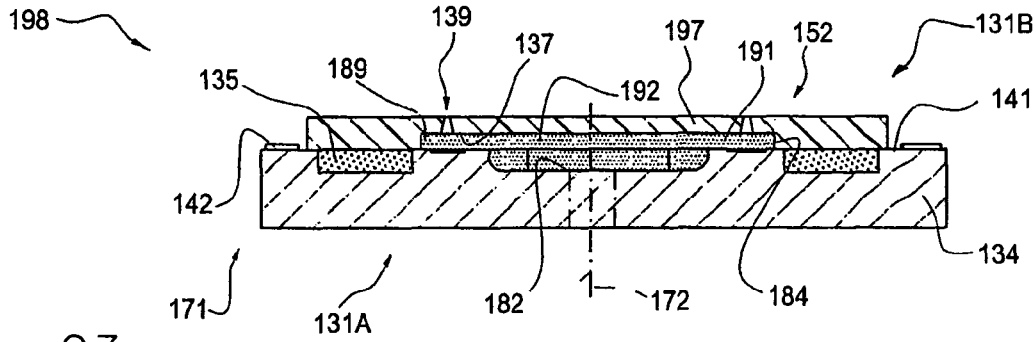
Figure 24:
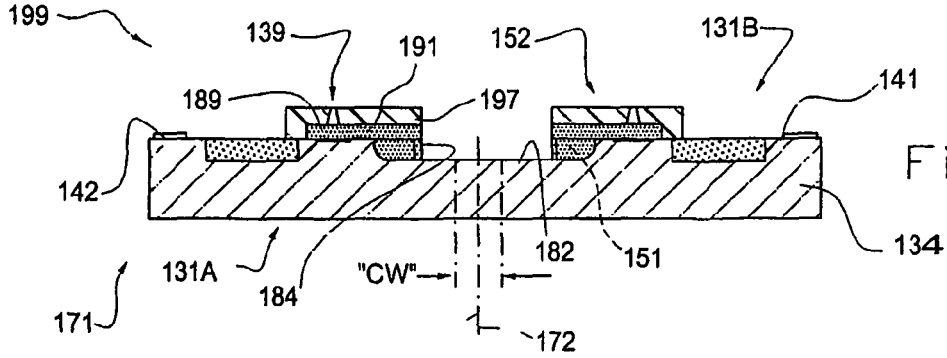
Figure 25:
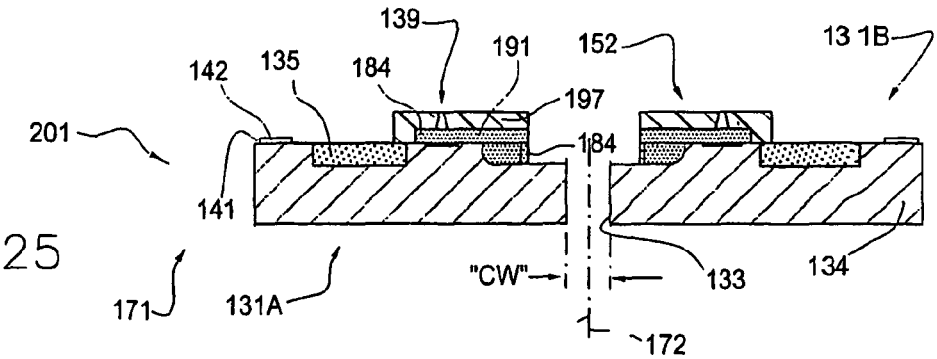
FIG. 25 represents a schematic section of the module of FIG. 8 in a further stage of manufacture of the invention.

The process continues with a step of deposition (FIGS. 16-18) of sacrificial volumes, a step (FIGS. 19-21) in which the limits of the cells 137 and of the channels 138 are defined, a step of formation of the structural layer and nozzles (FIGS. 22 and 23) and a cutting step (FIGS. 24 and 25).

In detail, the step of deposition of the sacrificial volumes may include a sub-step 183 (FIG. 16) in which a layer of photoresist 184 is spread to cover the etch 182. In a sub-step 186 (FIG. 17) the traces of photoresist are removed from the face 141, for instance by means of treatment with oxygen plasma, and the photoresist covering the 182 is planarized.

In a sub-step 187, (FIG. 18) over the entire face 141 and on the layer covering the etch 182 a layer of photoresist 184 of thickness 10-25 μm is deposited, after drying.

The limit definition step, designated with numeral 188 (FIG. 19), includes exposure of the photoresist 184 with a mask that defines the limits of the cells 136, of the channels 138 and of the distribution channel 149, and development of the photoresist. Sacrificial volumes, indicated with numerals 189 and 191, are thus formed above the resistors 136 and in the area to the distance "C" for definition of the cells 137 and of the channels 138 and the sacrificial volumes 192 in the space between the ribs and in the rest of the etch 182.

Figure 20:
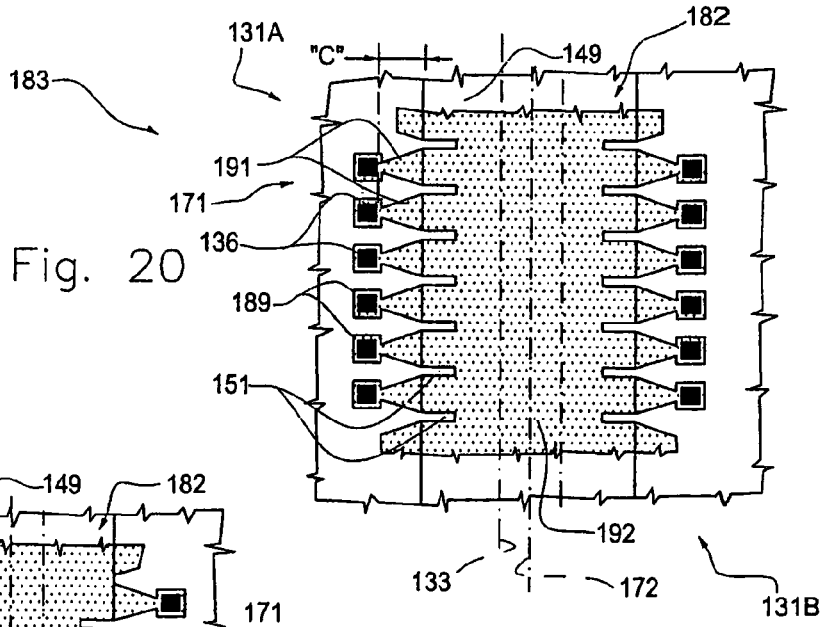
FIG. 20 is a plan view of a part of the module of FIG. 8 in the stage of FIG. 19.
Figure 21:
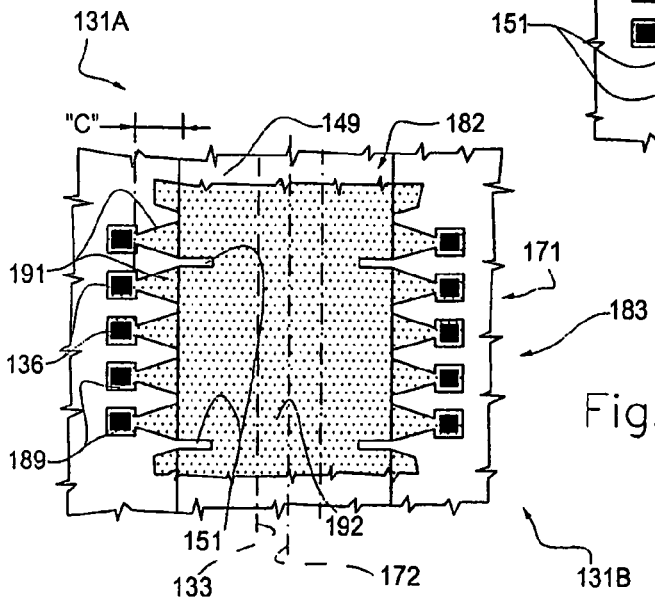
FIG. 21 is a plan view of the module variant of FIG. 14, in the manufacturing stage of FIG. 19.

The upper surfaces of the ribs 151 remain uncovered in the disposition where there is one pair for each channel 138, as indicated in FIG. 20 or in the disposition where there is one pair for a plurality of channels 138, as indicated in FIG. 21.

In the step of formation of the structural layer, indicated with numeral 196 (FIG. 22), a structural layer 197 is deposited on the face 141, on the ribs 151 and on the sacrificial volumes 189, 191 and 192.

By way of example, the structural layer 197 may be a negative photoresist such as SU8 or similar, suitable for exposure and development for revealing the pads 142 and with subsequent polymerisation before separation from the wafer or may be polymer type, which can be processed after separation from the wafer.

Step 196 is followed by step 198 (FIG. 23) of formation of the nozzles in which the nozzles 139 are made on the two sections 131A and 131B of the chip block 171, in correspondence with the cells 137.

The step 198 can take place on the wafer 173 if the layer 197 is the negative photoresist, or after separation of the module 131, for instance using excimer lasers, in the case of the polymer layer.

The cutting step includes, as an example, an ablation substep 199 (FIG. 24), using lasers for instance, in which the structural layer 197 and the photoresist 184 above the etch 182 are removed, on the edges of the plane 172 a short distance from the ends of the ribs 151, over a width slightly greater than "CW".

Figure 26:
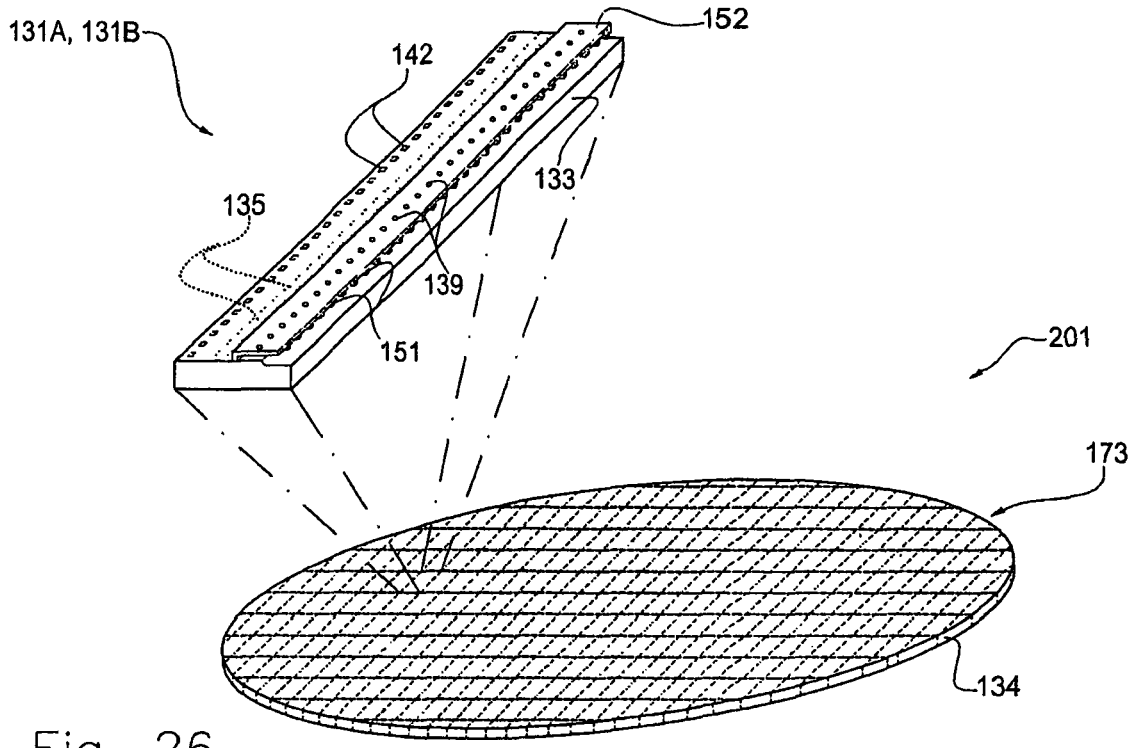
FIG. 26 shows the wafer of FIG. 10 in the manufacturing stage of FIG. 25.

This is followed by a cutting step true and proper 201 (FIGS. 25 and 26) in which the modules 131A and 131B are separated from the wafer 173, using a saw for example, for the cut of width "CW", which is symmetrical with respect to the plane 172, and which defines the sides 133 of the two modules that can be obtained from the block 171.

The ablation step 199 (FIG. 24) prevents the saw used for cutting the silicon from getting stuck in the organic material of the layers 197 and 184. The modules 131 including the sacrificial volumes are then separated from the wafer 173.

Production of the head 130 in accordance with the invention now involves a preparation step, in which the support 132 is available (FIG. 30) and in which the feeding duct 143 for one or more modules 131 and a bearing surface 203 are enhanced.

In a step 204 (FIG. 27*a*) the modules 131 are mounted on the bearing surface 203 of the support 132 with the respective fronts 133 adjacent to the feeding duct 143 and aligned with one another. This can be done using adhesive and with positioning techniques known in the art which guarantee alignment of the modules 131 and a constant pitch between the nozzles of the modules, in a the same way as described in the already mentioned patent application TO 2002 A 000876.

If the support 132 is the flat board 159, the frame 161 is mounted upon it, using an adhesive for example, in such a way that its inside part is adjacent to the duct 143 and its upper surface is flush with the upper surface of the layer 152.

Using low viscosity glue 207 (FIG. 6) for instance, the gaps between contiguous modules 131 and between the first and the last module of the line and the frame 161 are also sealed.

In a step 208 (FIG. 27*b*) the sacrificial volumes are removed from the modules 131, thus producing the cells 137 and the delivery channels 138 in the nozzle layer 152, with fluid communication between the ink distribution channel 149 and the cells 137, though leaving the layer 152 attached to the ribs 151.

The sealing laminae 153 (FIG. 28) with tapering edge 156 are now obtained, for instance through electroforming of gold-plated Ni with thickness 20-50 μm and to which the various parts of adhesive film 155 are already applied.

Then, in a step 209 (FIG. 29) the sealing lamina 153 is attached on the nozzle layer 152 of the module or of the modules 131 and on the upper surface 162 of the frame 161 using the adhesive film 155, in such a way that the edge 156 is adjacent to the nozzles 139 and ink-tightness is ensured in feeding the ink between the feeding duct 143 and the nozzles 139.

The head 130 (FIG. 6) is finally completed with soldering of the conductors 146 to the pads 142 and 144, according to known techniques.

Second Embodiment

Shown in FIG. 31 is a part of an ink jet printhead, indicated with the numeral 221, in accordance with a second embodiment of the invention, similar to the head 130 of FIG. 6 and comprising a series of ejection modules 222 and a support for the modules 222 identical to the support 132.

The head 221 has been represented in FIGS. 31-40, with functionally identical components being given the same numbers as in the FIGS. 6-30.

The modules 222 also have a substantially rectangular shape with a front 223 and each comprises a silicon chip 224 (FIG. 32) having driving circuits 135 and resistors 136, ejection cells 226, delivery channels 227 for the ink of the cells 226 and ejection nozzles 228. The circuits 135 and the resistors 136 are integrated on a face 229 of the chip 224, with the resistors 136 arranged parallel to the front 223. The cells 226 and the channels 227 are formed on the face 229, upon which the pads 142 for the circuits 135 and for the resistors 136 are also deposited.

The support 132 (FIGS. 31, 33 and 40*b*) defines the feeding duct 143 and may include the slotted board 159 and the frame, indicated here with numeral 230. Also provided are the solder pads 144 connected with the pads 142 of the modules 222 through the conductors 146 and solder pads, not shown, for the connection with the printing device.

In accordance with the invention, the head 221 comprises in each module 222 a distribution channel 231 which, in this embodiment, is made on a face 232 of the chip 224 opposite the face 229 and a series of slots 233 passing through the face 229 and the channel 231. The channel 231 also extends over the entire length of the chip, parallel to the front 223 and adjacent to it and is in fluid communication with the delivery channels 227 through the slots 233 and, when the head 221 is assembled, with the duct 143.

The distribution channel 231 has no bank at the end facing the front 223. In addition, both the front 223 and the delivery channels 226 and the slots 233 are made in a projecting section 236, of limited thickness, of the chip 224.

The slots 233 are associated singularly with the delivery channels 226, but can also be associated with various channels or according to a combination of the two.

A nozzle layer 237 rests upon the face 229 and is integrated leak-tight with respect to the face 229 of the chip 224, delimiting the ejection cells 226 and the channels 227. The layer 237 extends over the projecting section 235 a short distance from the front 223.

Made on the layer 237, above the cells 227, are the nozzles 228 (FIG. 33). Sealing means, indicated with 238, are placed between the fronts 223 or the nozzle layer 237 and the support 132 for fluidic sealing of the ink between the duct 143 and the cells 226.

In this embodiment, the sealing means 238 are made of sealing material 239 inserted between the front 223 and/or the nozzle layer 237 of the modules 222 and the frame 230 of the support 132.

The chip 224 can also be ½" or 1" long. It is 1.5-3.0 mm wide, 0.38 mm thick and the projecting section is of roughly 0.1 mm. The delivery channels 227 can be very short, for instance 0.2 mm, thus further reducing the fluidic impedances in feeding the ink and giving a high operating frequency.

With a nozzle density of 300 dpi and single association between channels 227 and slots 233, the length of the pass-through slots may be 30-50 μm. In the case of slots serving two or more channels, length may be 80-150 μm with reduced impedance of the fluidic circuit. The cells 226 and the delivery channels 227 in turn have a height of 10-25 μm.

With reference to FIG. 34, the process for manufacturing the printhead 221 comprises a step of forming chip blocks 242 each having, on the upper face 229, the circuits 135 and the resistors 136. The resistors are aligned parallel to a transversal reference plane 243 of the chip and the circuits 135, with respect to the resistors 136, are arranged on the side opposite that of the plane 243.

The chip block 242 represents one of numerous sections of a silicon wafer 173 identical to that of FIG. 10, with like integration of the circuits 135, resistors 136 and pads 142 and with the various manufacturing steps being carried out directly on the wafer 173 until the complete module 222 is obtained.

The manufacturing steps can employ the most effective techniques of depositing protective and structural layers, photolithographic etching and use of sacrificial layers used in the production of serial heads, including the improvements of the above-mentioned Italian patent 1.310.099 regarding the use of sacrificial layers of copper and those of Italian patent 1.311.361, filed by the applicant Olivetti Lexikon S.p.A.

Again in this case, the reduced dimensions and the compactness of the chip blocks 242 ensure an optimal sectioning of the wafer 173 with minimum wastage of material.

From a chip block, at the end of the process, two ejector modules 222, indicated with numerals 222A and 222B can be obtained. The block 242 is of the same length as a single module 222 and is just over twice as wide for definition of a space "CW" intended for the cut to separate the modules.

The two modules 222A and 222B develop as mirror images of one another in two sections with respect to the reference plane 243, starting from the sides of the chip block 242.

In accordance with the invention, the manufacturing process of the printhead 221 comprises an etching step 244 in which a longitudinal etch 246 is made on the face 232 of each chip block 242, opposite the face 229. The etching 246 is symmetrical with respect to the plane 243 and produces in the sections 222A and 222B the distribution channels 231, separated by the space of width "CW".

The etchings 246 can be made on the wafer with well-known, wet etching type techniques leaving a "membrane", for instance of 100 μm, symmetrical with respect to the reference plane 243 defining the projecting section 236.

The process continues with a protective deposition step 247 (FIG. 35) in which a protective layer 248 is deposited on the faces 232 and on the etchings 246. Depending on which technology is used for forming the feeding slots, this layer 248 may be made of an $SiO_2$ oxide (PECVD) or of a photoresist (PHR). The layer 248, in a solution with SiO2 is then etched or, respectively, masked, exposed and developed leaving, on the bottom, areas 249 not protected by SiO2, corresponding to the sections of the slots 233.

Next comes a forming step 251 in which sacrificial volumes 252, 253 are made above the resistors 136 (FIG. 36) and up to a distance "C" from the resistors, delimiting the cells 226 and the channels 227.

Then there is a forming step 262 (FIG. 37) in which a structural layer 263, for instance Su-8 or Polyimide type, is deposited to form the nozzle layer 237 on the face 229 and on the sacrificial volumes 252 and 253. Also formed are the nozzles 228, with photolithographic techniques with laser ablation, depending on the type of layer.

This is followed by a step for forming slots 264 (FIG. 38) in which the slots 233 are made in the thickness of the projecting sections 236 and in correspondence with the delivery channels 227. The step 264 can be carried out following a "Dry etching" process through the mask of $SiO_2$ of the layer 248, or by sand-blasting and silicon PHR mask or by electrochemical etching, exploiting the copper deposited as the contact electrode, in accordance with the above-mentioned Italian patent 1.311.361.

Next is a cutting step 266 in which the sections 222A and 222B of the chip block 242 (FIG. 39) are separated from the wafer 173 and from one another, for instance by sawing. In separating the modules 222, the cut of width "CW" is symmetrical with respect to the plane 243 and defines the fronts 223 of the two modules made from the chip block.

In production of the head 221 according to the invention there is now a preparation step, in which the support 132 with the ink feeding duct 143 is prepared for one or more modules 222.

In a step 268 (FIG. 40*a*), the modules 222 are mounted on the bearing surface 203 of the support 132, for instance by means of adhesive, with the projecting part 236 above the feeding duct 143 and with the respective fronts 223 adjacent to the duct and guaranteeing that the nozzles are aligned and have a constant pitch.

When the support 132 is the board 159, the frame 230 is glued in such a way that its internal part is adjacent to the duct 143 and its upper surface 271 is slightly under the upper surface of the nozzle layer 237 of the modules 222.

Next, in a step 272 (FIG. 40*b*), the gaps between the contiguous modules 222 and the gaps between the fronts 223 and the upper surface 271 of the frame 230 are sealed with the sealing material 239, a low viscosity glue for instance.

The sacrificial volumes 252, 253 are then removed from the modules 222 making the cells 226 and the delivery channels 227 in the structural layer 263, with fluid communication between the ink distribution channel 231 and the cells 226.

The head 221 is finally completed with soldering of the conductors 146 to the pads 142 and 144, according to known techniques.

Naturally, without prejudice to the principle of the invention, the embodiments and the manufacturing details of the ink jet head and of the relative manufacturing process may be changed significantly compared to what has been described and illustrated by way of non-restrictive example, without departing from the scope of the invention.

The invention claimed is:

1. An ink jet printhead comprising:

one or more ejection modules each including:

a silicon chip having a front surface and a top surface, a plurality of heating elements arranged parallel to the top surface of the silicon chip, a plurality of ejection cells located above the heating elements, delivery channels to deliver ink to the ejection cells, a main distribution channel defined in the top surface of the silicon chip orthogonally to the delivery channels, the main distribution channel extending along the front surface of the silicon chip without interruptions, and a nozzle layer integrated with the top surface of the silicon chip, the nozzle layer including ejection nozzles located above the respective ejection cells, wherein the ejection nozzles are parallel to the heating elements and the top surface of the silicon chip;

a support for mounting the module or the modules and which defines a feeding duct for the ink, the feeding duct being in fluid communication with the front surface of the silicon chip and the main distribution channel;

a seal between the module or the modules and said support, the seal arranged to form a fluid seal between the feeding duct of the support and the ejection cells of the module or of the modules; and a plurality of ribs extending between the delivery channels and the main distribution channel, the ribs extending transversely to the main distribution channel to form a further distribution channel orthogonal to the main distribution channel, the ribs bearing against the nozzle layer;

wherein there is one pair of ribs for each delivery channel or one pair of ribs for a plurality of delivery channels.

2. Printhead according to claim 1, wherein in said module or in each module, the ejection cells are positioned at 0.5-1.0 mm from said front surface.

3. Printhead according to claim 1, wherein said distribution channel is defined by a surface etching in the relative silicon chip.

4. Printhead according to claim 1, wherein each chip defines a reference surface upon which are arranged said ejection cells, and the distribution channel of the module or of the modules is made in an area of a reference surface that includes said front surface; said seal includes a sealing lamina having an edge adjacent to the nozzles and mounted to provide fluid sealing between the nozzle layer and said support and to cover the feeding duct.

5. Printhead according to claim 4, wherein the sealing lamina is limited by a tapering edge adjacent to said nozzles.

6. Printhead according to claim 4, wherein the upper surface of the frame is substantially flush with the upper surface of the nozzle layers and wherein said sealing lamina is mounted tight on the frame and on the nozzle layers of the modules, in correspondence with the ribs.

7. Printhead according to claim 1, wherein said ribs are set adjacent to each delivery channel.

8. Printhead according to claim 1, wherein said ribs are set adjacent to a plurality of delivery channels.

9. Printhead according to claim 1, wherein the nozzle layer defines the ejection cells and the delivery channels, and is fastened to said ribs.

10. Printhead according to claim 1, wherein the distribution channel is of width 0.3-1.0 mm and said ribs extend for a distance of 0.2-1.0 mm in said distribution channel.

11. Printhead according to claim 1, wherein said ribs are of width 15-30 μm.

12. Printhead according to claim 1, wherein the cells and the delivery channels rest upon a given surface of said chip, and in said module or in each module, the distribution channel is made on a surface of the chip opposite to said given surface, facing the feeding duct of the mounting support and wherein ducts or slots are provided, passing through said chip which provide fluid connection between the distribution channel on said opposite surface and the delivery channels on said given surface.

13. Printhead according to claim 12, wherein said nozzle layer acts as a fluid seal for said cells and for said channels with respect to said given surface of the chip.

14. Printhead according to claim 12, wherein said distribution channel is adjacent to said front surface, has no bank and defines in the chip a projecting section of lesser thickness and in which said nozzle layer extends over said projecting section.

15. Printhead according to claim 12, wherein said seal includes sealing material inserted between the nozzle layer and/or the chip and said support.

16. Printhead according to claim 12, wherein said sealing material is arranged between said frame and the nozzle layer or the relative chip of the modules.

17. Printhead according to claim 1, wherein said nozzle layer defines spaces above the substrate for a height of 10-25 μm in said cells and in said delivery channels.

18. Printhead according to claim 1, used in a parallel or serial-parallel type printing device, the printhead further comprising a plurality of modules aligned along said front surface, wherein said support comprises a board of rigid material that defines said feeding duct through its thickness; and wherein said modules are mounted side by side on said board and with the nozzles aligned parallel to the front surface.

19. Printhead according to claim 18, further comprising a frame mounted on said board beside said ejector modules having the upper surface adjacent to the upper surface of the nozzle layers of the modules.

20. Process for manufacturing an ink jet printhead, comprising the steps of:

preparing ejector modules, each including:

a chip substrate having a front surface and a top surface, a plurality of resistors arranged parallel to the top surface of the chip substrate, a plurality of ejection cells located above the resistors, delivery channels to deliver ink to the ejection cells, a main distribution channel, defined in the top surface of the silicon chip, the main distribution channel extending orthogonally to the delivery channels, and along the front surface of the chip substrate without interruptions, and a nozzle layer having ejection nozzles aligned above the resistors and adjacent to an edge of the module, said ejection nozzles being parallel to the resistors and the top surface of the chip substrate providing a support having an ink feeding duct for one or more modules, the ink feeding duct being in fluid communication with the front surface of the chip substrate and the main distribution channel;

mounting the module or modules on said support so as to have the main distribution channel or channels in fluid communication with said feeding duct;

hydraulically sealing the nozzle layer of the module or of the modules from said support, for ink-tightness in feeding the ink between the feeding duct and the nozzles through said delivery channels;

making an etching on a given face of the chip substrate to produce said main distribution channel extending along the front surface of the chip substrate without interruptions;

producing sacrificial volumes for defining the limits of the ejection cells above the resistors and the delivery channels above the area;

applying a structural layer over said sacrificial volumes to define said nozzle layer;

wherein said etching step produces on said face, in addition to the main distribution channel, a series of ribs that extend transversely across the main distribution channel between the delivery channels and the main distribution channel to form a further distribution channel orthogonal to the main distribution channel and in fluid communication with both said delivery channels and said main distribution channel, and in which a part of the sacrificial volumes extend into the space between said ribs and on said main distribution channel, further wherein a part of the structural layer is applied on the ribs and remains fastened on said ribs after removal of the sacrificial volumes.

21. Process according to claim 20, further comprising:

producing the ejection nozzles on said structural layer in correspondence with the sacrificial volumes of the cells.

22. Process according to claim 20, wherein producing the sacrificial volumes comprises:

(a) covering said distribution channel with sacrificial photoresist, flush with said data face of the chip;

(b) planarizing the photoresist covering the channel and cleaning the parts adjacent to said distribution channel;

(c) applying a layer of controlled thickness of sacrificial photoresist on said substrate above the resistors, the ribs and the photoresist covering the channel;

(d) exposing with a mask said layer of controlled thickness for defining said cells, the delivery channels and the distribution channel and delimiting said ribs; and (e) developing said layer of controlled thickness constituting the sacrificial volumes for said cells, for the delivery channels and for the distribution channel and leaving zones for attachment of the chip beside said cells and the distribution channels and on said ribs.

23. Process according to claim 20, wherein said longitudinal etching is made on the face of the chip, opposite the said given face, forming a projecting section delimited by said front and in which a slot forming step is provided, in which slots are produced in the thickness of the projecting sections and in correspondence with the delivery channels and in which, for assembling of the head, the modules are mounted on the bearing surface of the support with said slots in fluid connection with the feeding duct of the support.

24. Process according to claim 23, wherein said seal includes sealing material inserted between the fronts of the chips and said upper surface.

25. Process for manufacturing a printhead according to claim 20, wherein said support includes a board with a bearing surface for said chips and an upper surface adjacent to the feeding duct and a distance from said bearing surface and wherein said upper surface is defined by a frame or is obtained directly from the board, the sealing step including the insertion of a seal between the chip or the structural layer and said upper surface.

26. Process according to claim 25, wherein said seal includes a sealing lamina glued between said upper surface and the structural layer, in contrast with said ribs.

* * * * *